US007942277B1

(12) United States Patent
Flynn

(10) Patent No.: US 7,942,277 B1
(45) Date of Patent: May 17, 2011

(54) MULTI-SADDLE RACK

(76) Inventor: James T. Flynn, Platteville, CO (US)

( * ) Notice: Subject to any disclaimer, the term of this patent is extended or adjusted under 35 U.S.C. 154(b) by 784 days.

(21) Appl. No.: 11/763,591

(22) Filed: Jun. 15, 2007

(51) Int. Cl.
*A47F 7/00* (2006.01)

(52) U.S. Cl. ..... 211/85.11; 211/1.53; 211/1.57

(58) Field of Classification Search ..... 211/85.11, 211/1.51, 1.57, 1.52–1.55; 108/94–96, 102, 108/103, 105, 108, 141, 147.11, 106; 248/123.11, 248/125.7, 284.1, 280.11
See application file for complete search history.

(56) References Cited

U.S. PATENT DOCUMENTS

| | | | | |
|---|---|---|---|---|
| 624,848 | A * | 5/1899 | McCausland | 223/111 |
| D42,635 | S | 6/1912 | Lackey et al. | |
| 2,809,755 | A | 10/1957 | Martorello | |
| 3,259,351 | A * | 7/1966 | Olsen | 248/325 |
| 3,294,267 | A | 12/1966 | Schweigert | |
| 3,315,819 | A | 4/1967 | Kingsbery | |
| 3,662,909 | A | 5/1972 | Cherry | |
| 3,721,416 | A * | 3/1973 | Goudreau | 248/325 |
| 3,802,702 | A * | 4/1974 | Pulley | 473/484 |
| 3,811,574 | A | 5/1974 | O'Brien | |
| 3,940,174 | A | 2/1976 | Mayes | |
| 3,973,748 | A * | 8/1976 | Nagasaka | 248/571 |
| D255,611 | S | 6/1980 | Love | |
| 4,266,747 | A * | 5/1981 | Souder et al. | 248/280.11 |
| 4,329,928 | A | 5/1982 | Shaw | |
| 5,362,078 | A | 11/1994 | Paton | |
| 5,615,783 | A | 4/1997 | Warnken | |
| 5,950,846 | A | 9/1999 | Duane | |
| 6,189,706 | B1 | 2/2001 | Akins | |
| 6,478,274 | B1 * | 11/2002 | Oddsen, Jr. | 248/274.1 |
| 6,659,476 | B2 | 12/2003 | Weida | |
| 7,500,573 | B1 * | 3/2009 | Flynn | 211/85.11 |
| 2004/0182803 | A1 | 9/2004 | Lay et al. | |
| 2007/0187345 | A1 * | 8/2007 | Hought | 211/85.11 |

OTHER PUBLICATIONS

U.S. Appl. No. 11/300,629, filed Dec. 14, 2005, Applicant: James T. Flynn.
Office Action from USPTO, dated Mar. 18, 2008, for U.S. Appl. No. 11/300,629, filed Dec. 14, 2005. Inventor: James T. Flynn, Conf. No. 4123.

* cited by examiner

*Primary Examiner* — Korie Chan
(74) *Attorney, Agent, or Firm* — Patent Law Offices of Rick Martin, P.C.

(57) ABSTRACT

A powered saddle rack can be mounted in a trailer tack room. A mounting rod rotates from a storage to a load/unload position. A working frame assembly further rotates to the load/unload position. Once in the load/unload position, a rack raising rod is lifted or lowered, thereby raising or lowering several saddle racks up and down. A portable version doesn't rotate.

10 Claims, 23 Drawing Sheets

MULTI-SADDLE RACK

CROSS REFERENCE APPLICATIONS

This application incorporates by reference U.S. patent application Ser. No. 11/300,629 filed Dec. 14, 2005.

FIELD OF INVENTION

The present invention relates to providing a stand of reachable saddle racks to accommodate easy loading, wherein the stand of saddle racks can be raised/lowered on a pole for convenience of storage.

BACKGROUND OF THE INVENTION

Horse trailers can carry a tack room for transporting four or more saddles. FIG. 1 (prior art) shows a horse trailer 1 having a tack room doorway 2. A rear wall 3 has four permanently mounted saddle racks 4, 5, 6, 7. The horseman has to physically lift a saddle up onto racks 5, 6, 7 wherein rack 4 is about at waist height.

U.S. Pat. No. 3,294,267 (1966) to Schweigert discloses a tack room ceiling mounted saddle rack that provides the rack to slide outside the tack room door at about waist height for loading two saddles. No lifting of a saddle to a higher storage position is suggested in this nor any known prior art reference.

Below follows a brief description of the related art.

U.S. Pat. No. 2,809,755 (1957) to Martorello discloses a single saddle stationary rack bolted to a closet floor.

U.S. Pat. No. 3,294,267 (1966) to Schwiegert discloses two saddle racks mounted from a closet ceiling bracket, wherein the rack slides out of the trailer for loading.

U.S. Pat. No. 3,315,819 (1967) to Kingsbery discloses a tree stand for saddles.

U.S. Pat. No. 3,662,909 (1972) to Cherry discloses a ceiling mounted bracket which supports a slidable saddle rack.

U.S. Pat. No. 3,811,574 (1974) to O'Brien discloses a ceiling mounted bracket for a slidable saddle rack.

U.S. Pat. No. 5,362,078 (1994) to Paton discloses a hard truck and saddle stand combination.

U.S. Pat. No. 5,615,783 (1997) to Warnken discloses a fold out stationary saddle rack.

U.S. Pat. No. 6,189,706 (2001) to Akins discloses a stationary blanket rack.

U.S. Pat. No. 6,659,476 (2003) to Weida discloses a hard truck and rack combo.

U.S. Pat. No. Des. 42,635 (1912) to Lack discloses a stationary hanging rack.

U.S. Pat No. Des. 255,611 (1980) to Love discloses a hand truck and rack combo.

U.S. Pat. Pub. No. US 2004/0182803 Lay discloses a sliding wall mounted rack.

What is needed in the art is a mechanism to allow easy loading of a plurality of saddles onto a stand of racks, wherein the stand of racks are then lifted up to a storage position, and then lowered when unloading is needed.

The present invention provides a motorized four or more saddle rack that allows loading four saddles at a convenient height. The stand of saddle racks after loading is raised up. The stand of saddle racks can also pivot 180° for storage in the tack room of a trailer.

SUMMARY OF THE INVENTION

An aspect of the present invention is to provide a mounting pole inside the doorway of a trailer tack room.

Another aspect of the present invention is to provide a pivotable rack lifting mechanism mounted to the mounting pole.

Another aspect of the present invention is to provide the rack lifting mechanism with an array of saddle racks that move lower for loading and higher for storage. These saddle racks can hold saddles and/or harnesses.

Other aspects of this invention will appear from the following description and appended claims, reference being made to the accompanying drawings forming a part of this specification wherein like reference characters designate corresponding parts in the several views.

The multi-saddle rack lift is mounted in the tack room of a trailer. A support post is secured between the floor and the ceiling. A frame is pivotally mounted to the support post. The frame has a motor that lifts a stand of saddle racks up and down in about one foot of travel. When the stand is down four or more saddle racks protrude from the tack room door for loading/unloading. For storage the motor raises the stand, and the user pivots the frame 90° into the tack room and pivots the stand 90° on the frame. Thus, the saddles are stored against the tack room wall at about a 180° orientation from the loading/unloading position.

Before explaining the disclosed embodiment of the present invention in detail, it is to be understood that the invention is not limited in its application to the details of the particular arrangement shown, since the invention is capable of other embodiments. Also, the terminology used herein is for the purpose of description and not of limitation.

DETAILED DESCRIPTION OF THE DRAWINGS

Figure 1:
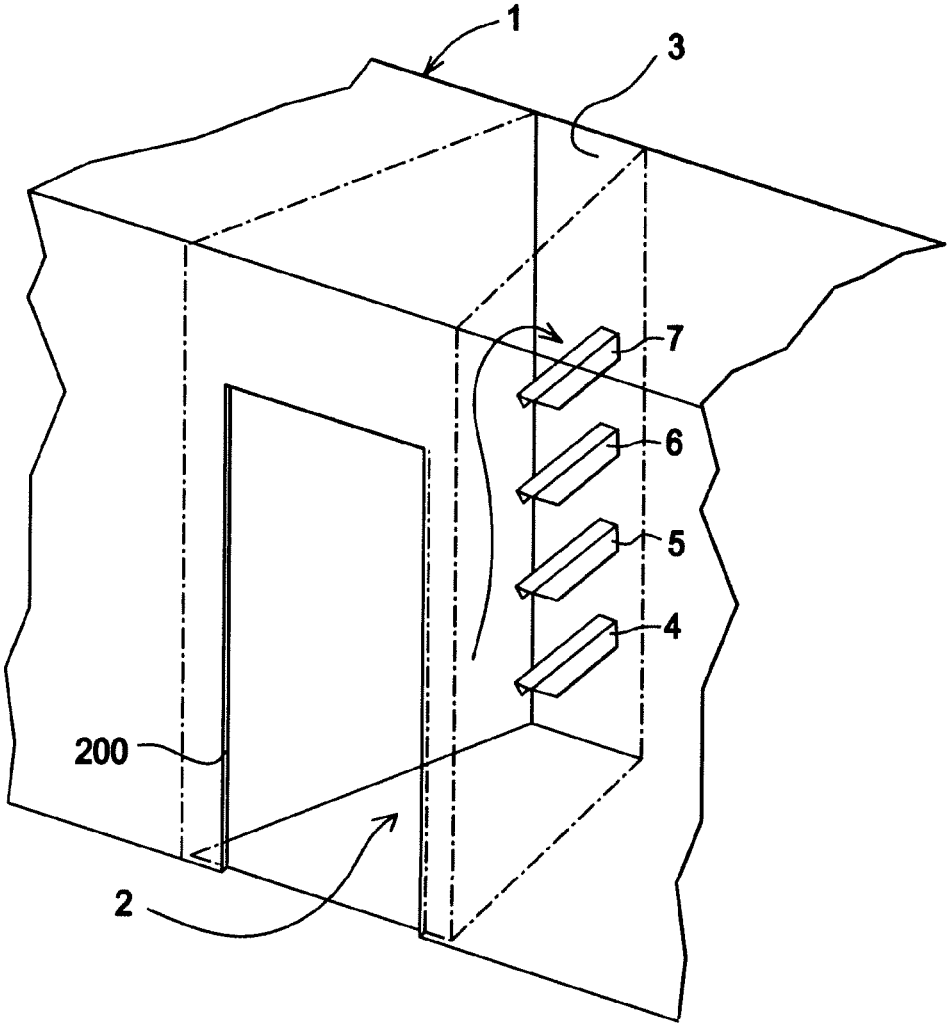
FIG.1 (PRIOR ART)
FIG. 1 (prior art) is a side perspective view of a trailer tack room stationary saddle rack array.

FIG. 1B (prior art) shows a horse trailer 1 having a tack room doorway 2. A rear wall 3 has four permanently mounted saddle racks 4, 5, 6, 7. The horseman has to physically lift a saddle up onto racks 5, 6, 7 wherein rack 4 is about at waist height.

Referring next to FIGS. 2, 3, 4, 5, 6 a saddle lift 10 is mounted to the floor 15 of trailer tack room 1. Bolts or screws 14 secure the anchor plate 13 to floor 15. Collar 16 of anchor plate 13 receives the lower end of mounting rod 11. Collar 16 of ceiling anchor plate 12 receives the upper end of mounting rod 11. The collar 16 of anchor plate 13 has a flange 50 upon which flange 51 rotates. Locking pin 52 is pushed into holes (not shown) in flange 50 to lock the mounting rod 11 at a desired rotational angle for loading/unloading or storage.

Mounting collars 17, 170 rotate on welded to mounting rod 11. They support frame brackets 18, 180 respectively. Vertical support beam 181 stabilizes the brackets 18, 180 which, in turn, support the weight of frame assembly 190 and any saddles loaded thereon.

Bracket 180 has a collar 191 and flange 192. Flange 193 rotates on top of flange 192 to a desired rotational angle. Flange 193 is fastened to bottom 199 of working frame 190.

Bracket 18 has a collar 194 to receive a rod 195 which is fastened to the top 196 of the rectangular working frame 190. Working frame 190 consists of top 196, sides 197, 198 and bottom 199.

Upper bracket 30 supports upper lift arm 33 via a bolt 32 and cotter pin 320. Lower bracket 31 supports lower lift arm 34 via bolt 32 and cotter pin 320.

The rack raising rod 35 is secured to the distal ends of upper and lower lift arms 33, 34 via U brackets 36, and bolts 32 and cotter pins 320.

Each saddle rack 80, 81, 82, 83 is secured to the rack raising rod 35 with a collar 37 and a bolt 32 and cotter pin 320. Spaced between the saddle racks remains a constant in the raising and lowering operation. Space $d_1$ is large enough to accommodate a saddle S.

Lift bracket 89 secures a pulley 90. Cable 92 threads through pulley 90 to reel 93 which is powered by motor 94, see FIG. 7. Cover 91 protects users. The cable 92 is anchored at 95 at its fixed end.

Figure 2:
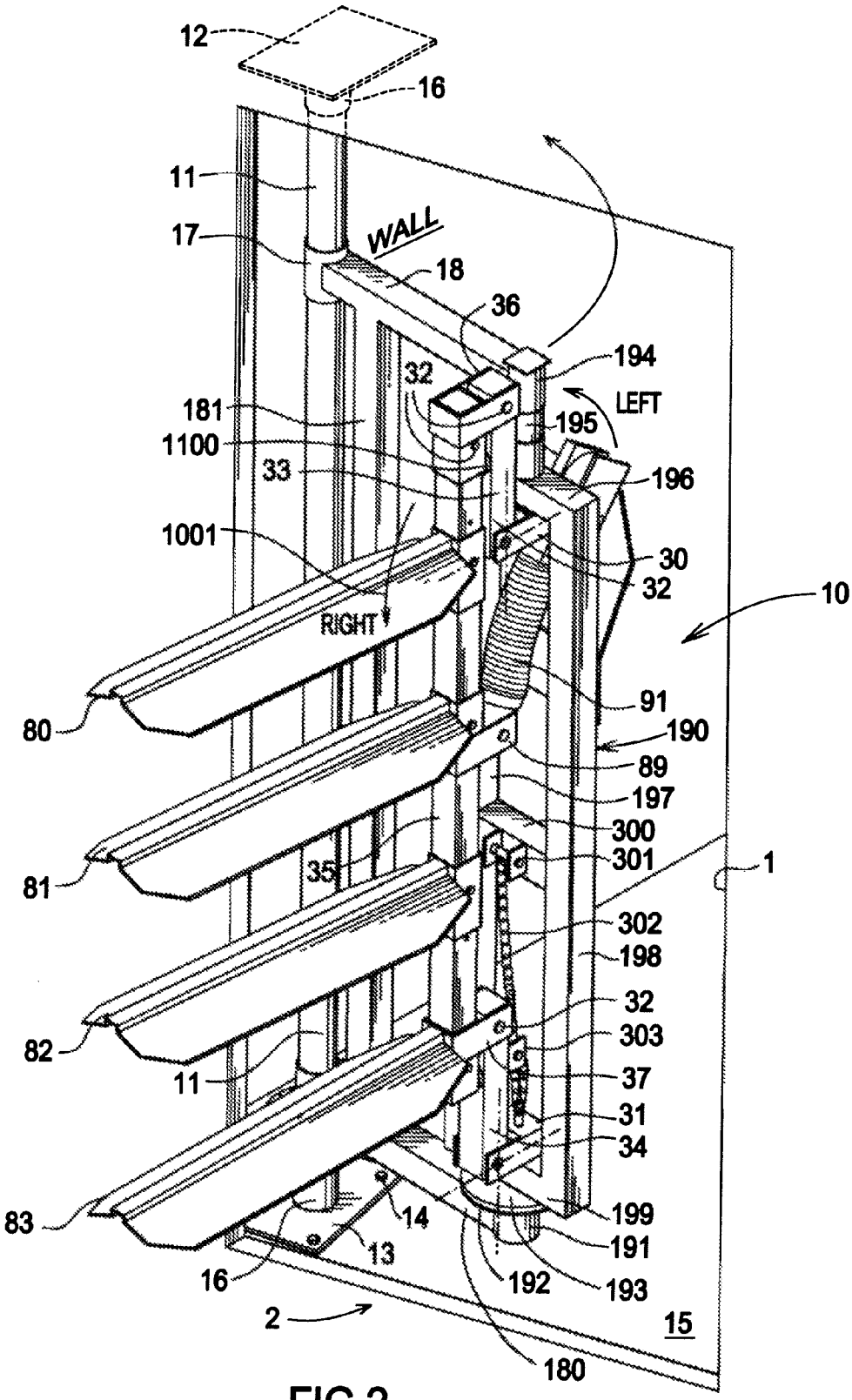
FIG. 2 is a side perspective view of a trailer tack room having the preferred embodiment lift shown in the raised position, rotated outbound from the tack room.
Figure 7:
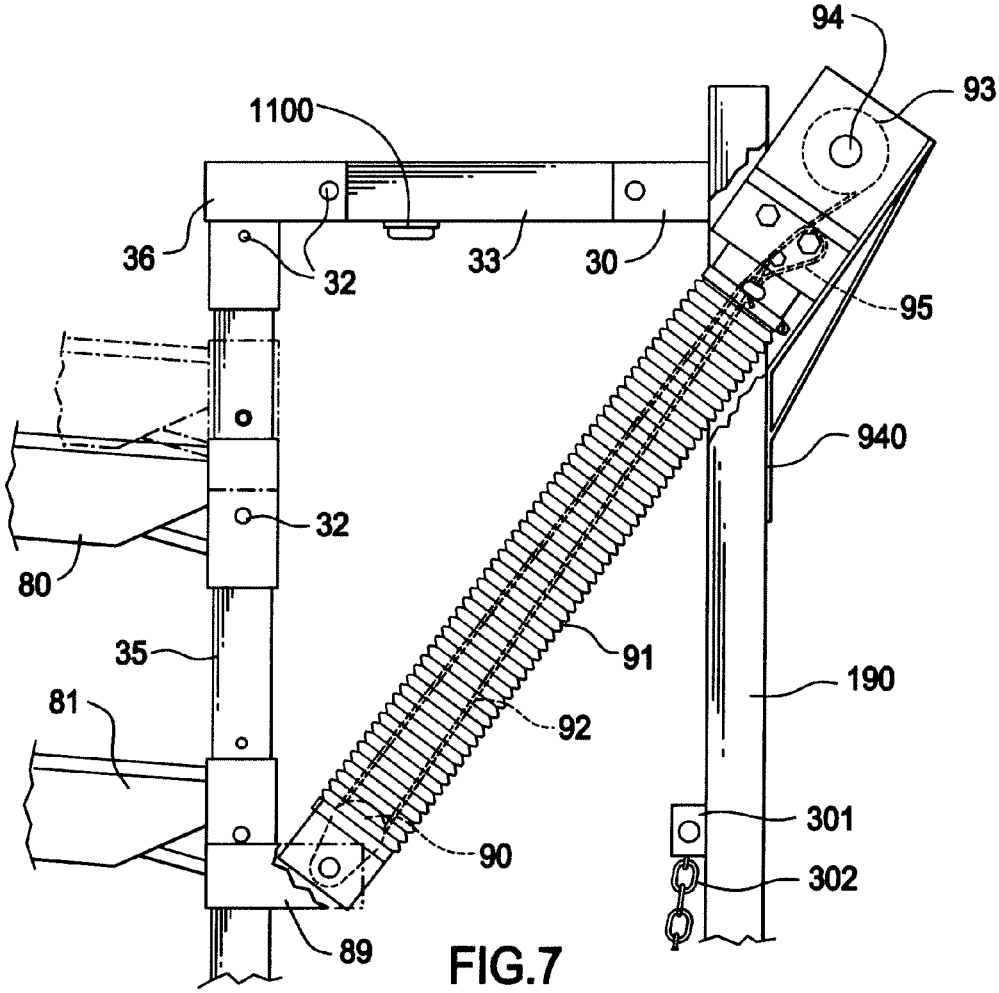
FIG. 7 is a side plan view of the motorized reel assembly.
Figure 8:
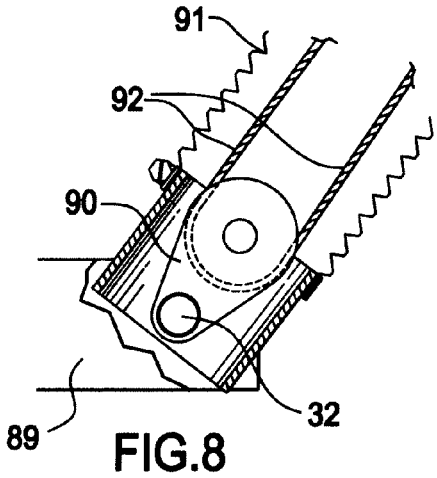
FIG. 8 is a close up cutaway view of the lower pulley of the reel assembly.
Figure 9:
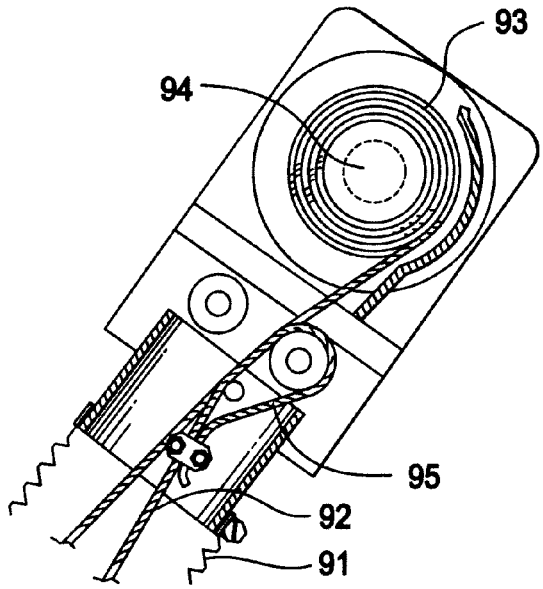
FIG. 9 is a close up cutaway view of the reel.

In FIG. 2 the reel 93 of FIG. 7 is wound all the way up, putting the rack raising rod 35 in the raised position (for storage).

Figure 3:
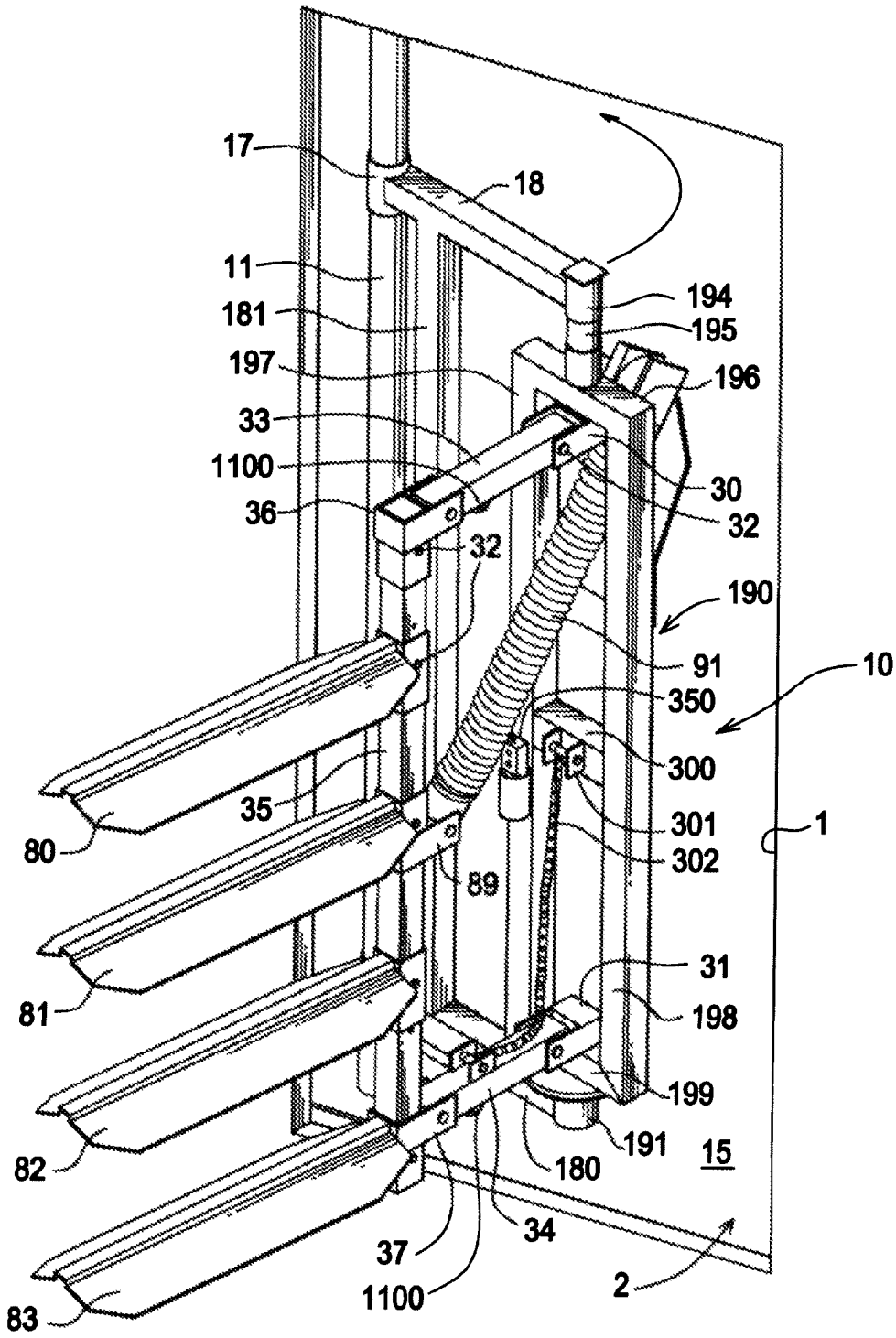
FIG. 3 is the same view as FIG. 2 with the lift in the lowered position.

In FIG. 3 the reel 93 is unwound about halfway, putting the rack raising rod 35 in a transition position.

Figure 4:
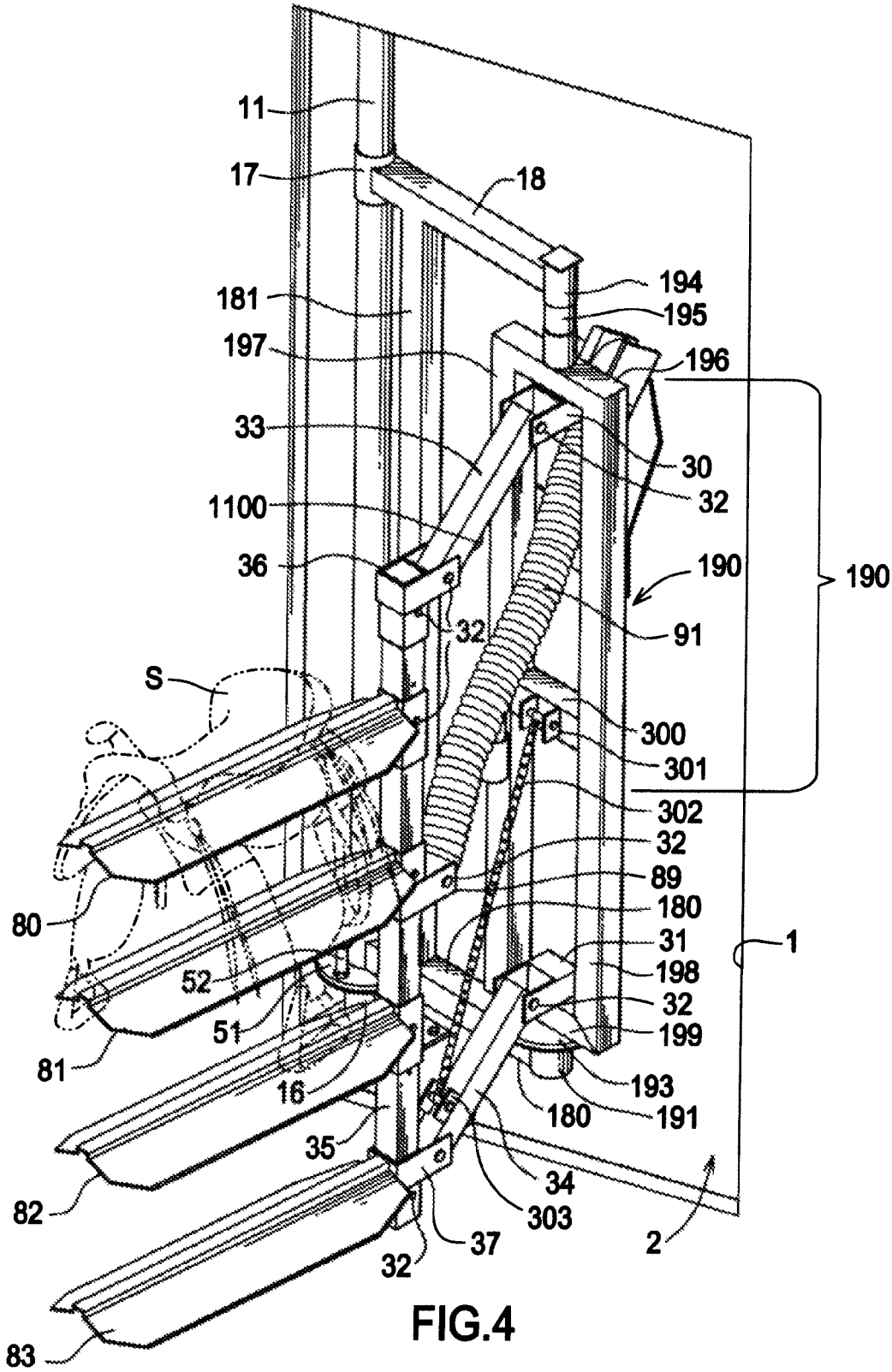
FIG. 4 is the same view as FIG. 2 with the lift in the lowered position.
Figure 5:
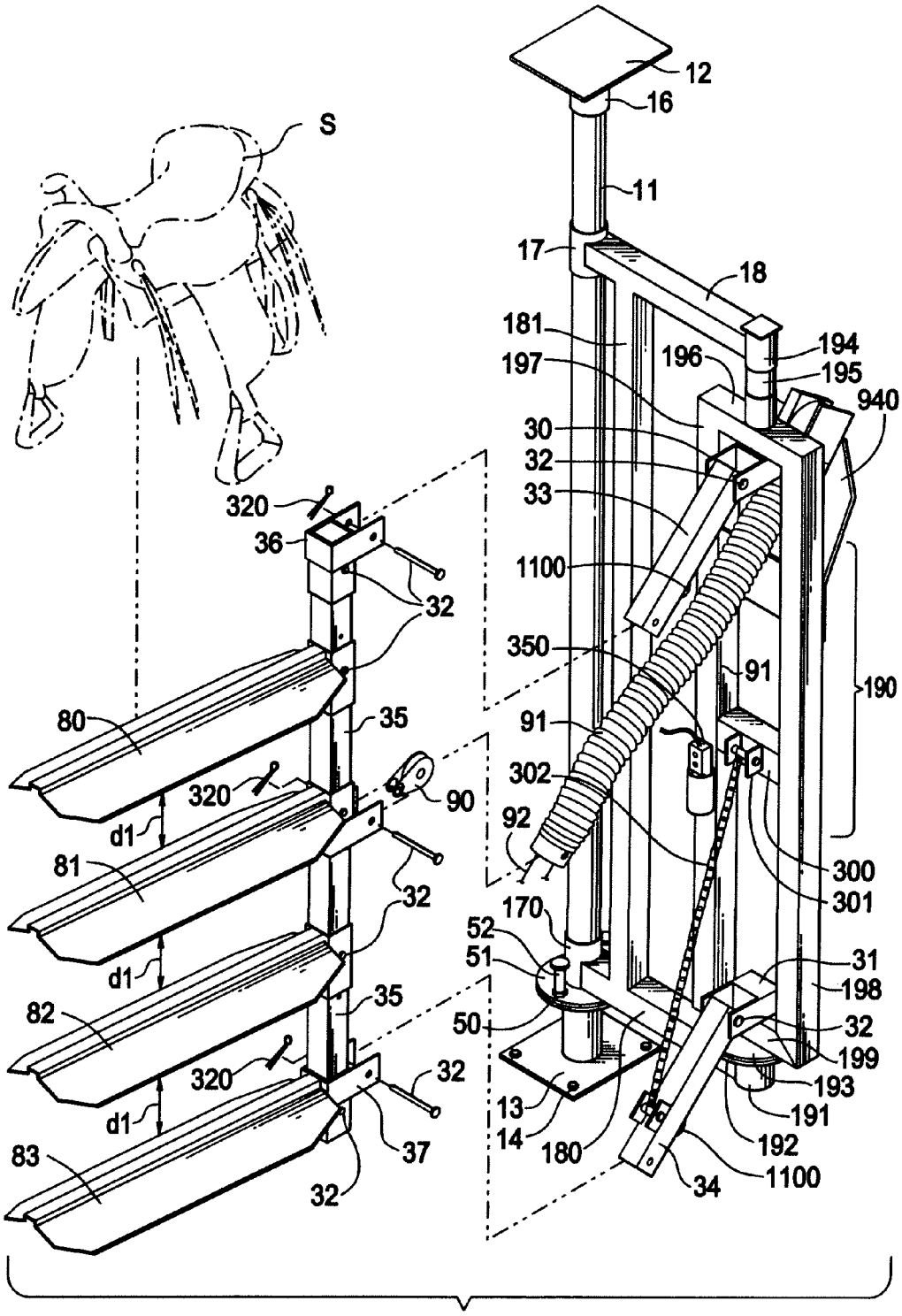
FIG. 5 is a partially exploded view of the FIG. 2 embodiment.

In FIG. 4 the reel 93 is completely unwound, putting the rack raising rod 35 in the lowered position (for loading/unloading saddles). For safety a crossbar 300 has an anchor 301 to secure chain 302 thereto, lower lift arm 34 has anchor 303 to secure a distal end of chain 302. Controller 350 controls motor 94 of FIG. 7.

Figure 10:
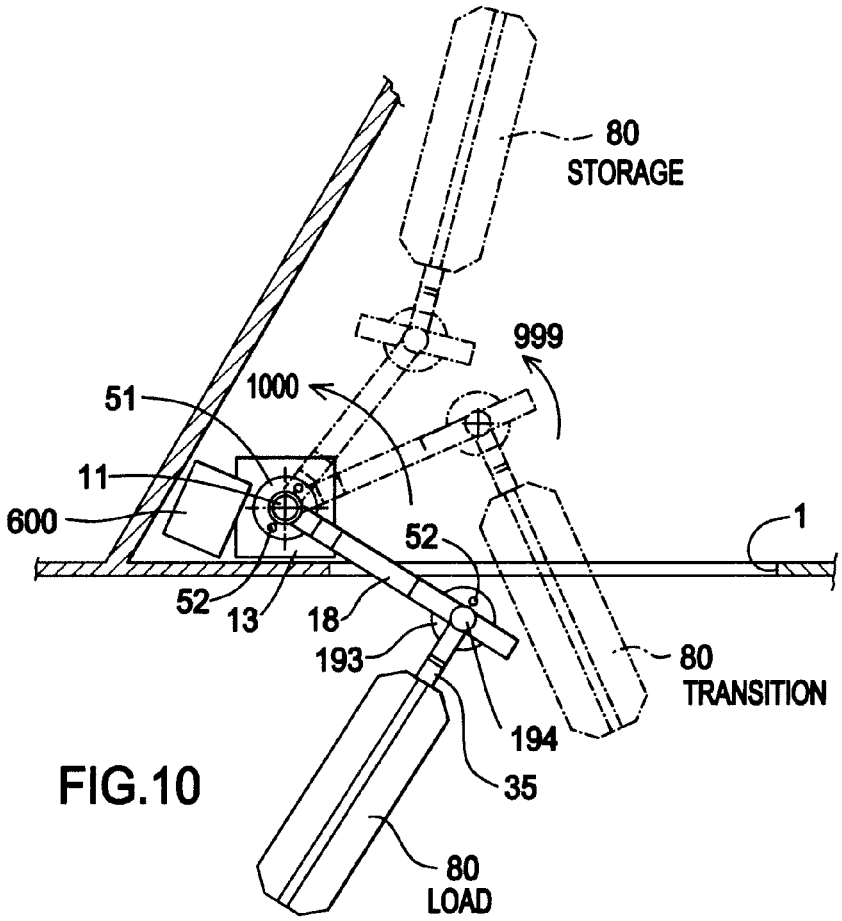
FIG. 10 is a top plan view of the saddle rack frame being rotated into the storage position.

In operation the user loads a saddle S as shown in FIG. 4. Next he operates the motor 914 to move the rack raising rod 35 to the upper (storage) position shown in FIG. 2. Next he rotates the working frame 190 into the tack room as shown in FIG. 10, arrow 999 and labels LOAD, TRANSITION, STORAGE. Next he rotates the mounting rod 11 back into the tack room as shown in FIG. 10, arrow 1000. This completes the operations for the storage mode labeled STORAGE.

FIG. 2 shows how the rack raising rod 35 can be lowered in direction 1001.

Figure 6:
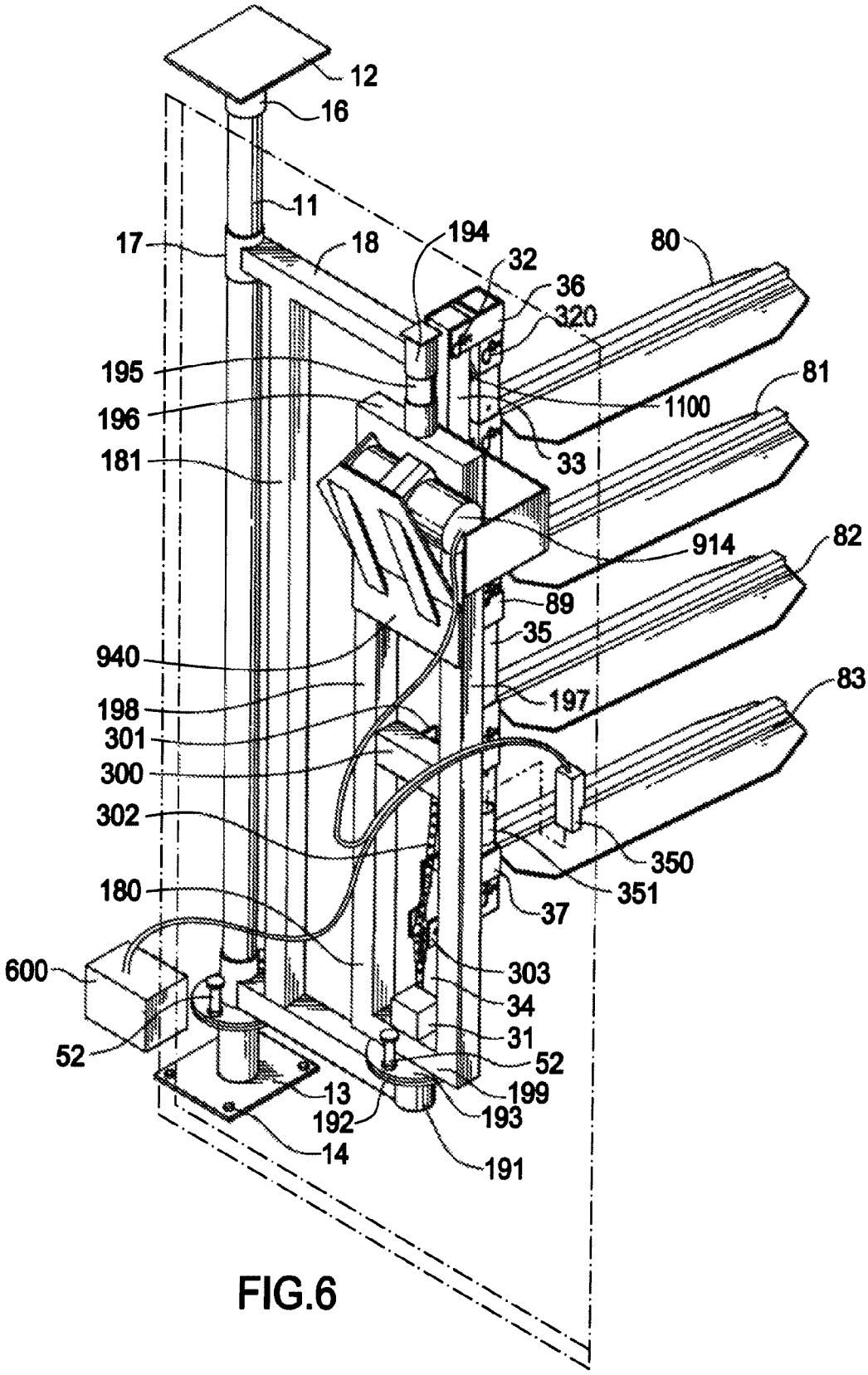
FIG. 6 is the same view as FIG. 2 with rack frame rotated into the tack room for storage.

Referring next to FIG. 6 a battery 600 powers the motor 914. A holder 351 holds the controller 350 for storage. A rack 940 secures the motor 914.

Figure 11:
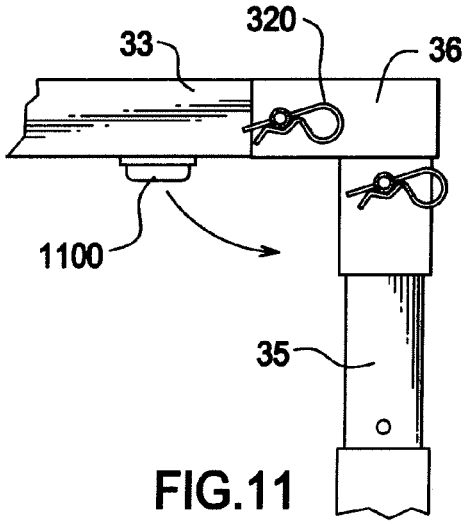
FIG. 11 is a close up side plan view of the lift arm in the raised position.
Figure 12:
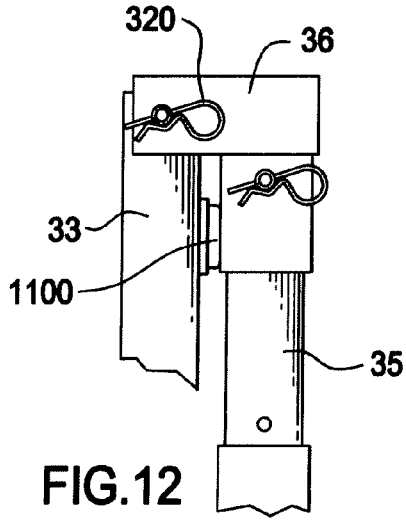
FIG. 12 is a close up side plan view of the lift arm in the lowered position.

In FIGS. 11, 12 a rubber cushion 1100 protects the upper lift arm 33 and the rack raising rod 35.

Figure 13:
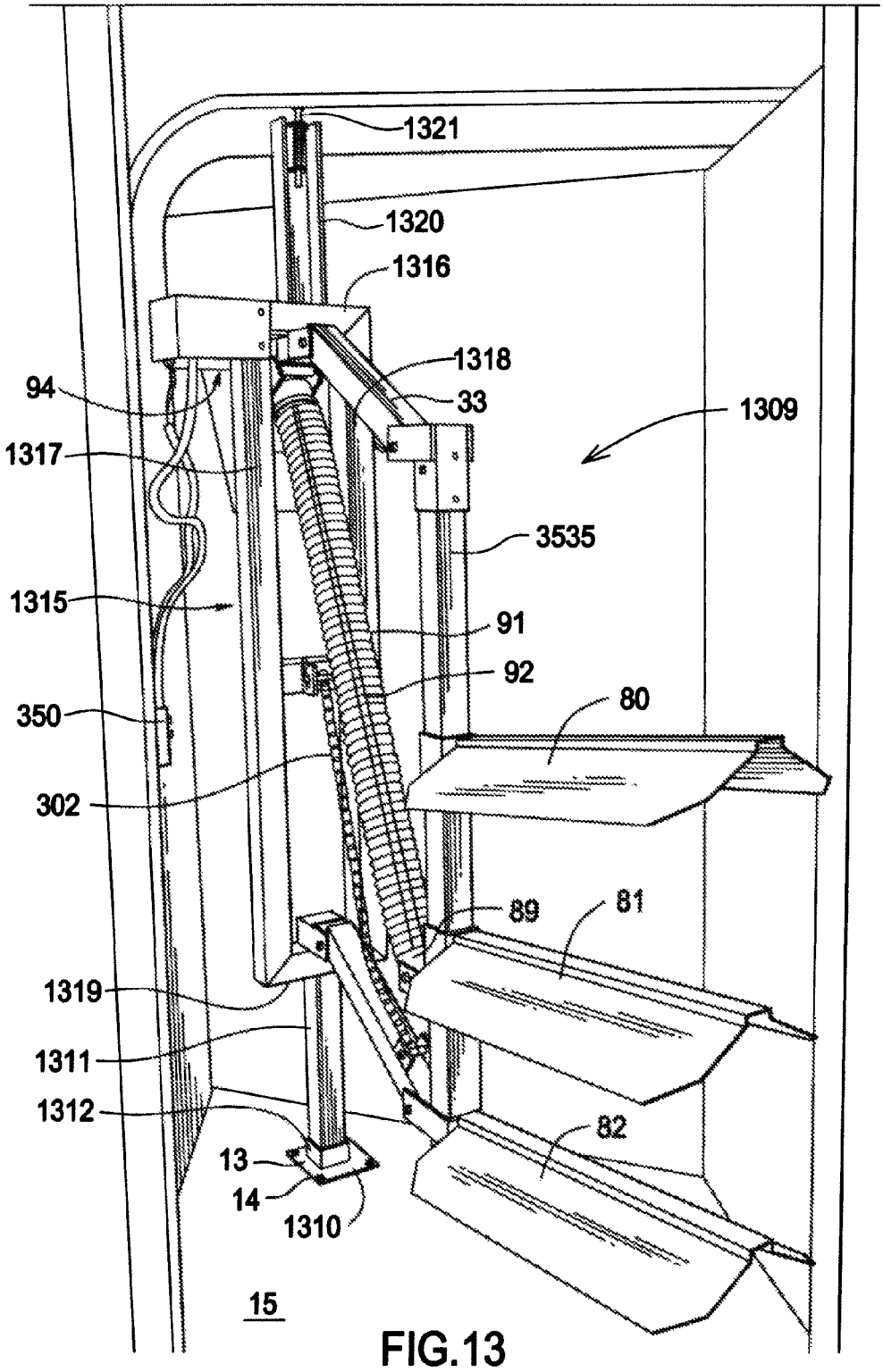
FIG. 13 is a front perspective view of a portable embodiment.

FIG. 13 shows a portable lift 1309. Anchor 1310 is fastened to floor 15. A square mounting rod 1311 is placed into the collar 1312 of anchor 1310. A working frame 1315 has a top 1316, sides 1317, 1318 and a bottom 1319. The top 1316 has a ceiling bracket 1320 with a locking pin 1321 to fit into a mounting hole in the ceiling. Motor 94 is controlled by controller 350 to lift the lift bracket 89 in the same manner as shown in FIG. 2.

Rack raising rod 3535 is chosen to be smaller than rod 35 so as to support only three saddle racks 80, 81, 82.

In operation the only moving parts are associated with rod 3535.

Referring next to FIGS. 14, 15, 16, 19, a hydraulic saddle lift 1000 mounts inside the doorway 2 of the horse trailer 1. Bolts or screws 14 secure the anchor plate 13 to floor 15. Collar 16 of anchor plate 13 receives the lower end of mounting rod 11. Collar 16 of ceiling anchor plate 12 receives the upper end of mounting rod 11. Collar 16 of ceiling anchor plate 12 receives the upper end of mounting rod 11. The collar 16 of anchor plate 13 has a flange 50 upon which flange 51 rotates. Locking pin 520 is pushed into holes (not shown) in flange 50 to lock the mounting rod 11 at a desired rotational angle for loading/unloading or storage.

Mounting collars 17, 170 rotate on rod 11. They support frame brackets 18, 180 respectively. Vertical support beam 181 stabilizes the brackets 18, 180 which, in turn, support the weight of frame assembly 1900 and any saddles loaded thereon.

Bracket 180 has a collar 191 and flange 192. Flange 193 rotates on top of flange 192 to a desired rotational angle. Flange 193 is fastened to the bottom of support wall 1400.

The top of support wall 1400 has a rod 1401 which is received by collar 1402 to enable the rotation of support wall 1400 to a desired rotational angle.

Upper bracket 1403 supports upper arm 1405 via bolt or rivet 1404. Lower bracket 1403 supports upper arm 1405 via bolt or rivet 1404. Brackets 1406 each have a bolt or rivet 1404 to support rod 1407 via bolts 1444. Joints labeled 1404 are pivot joints. Locking bolts (or pins) 1444 do not pivot. Cotter pins 1950 may be used.

Four collars 1500 each have a support rod 1410 to support a saddle rack 800, 810, 820, 830. The knobs 1411 have a bolt 1900 which threads through the collar 1500 into a selected hole 1412, thereby providing a chosen distance d2 between the saddle racks 800-830.

The support rod 1407 is powered up and down by means of a clamp 1420 to which a connecting arm 1421 is attached. A fastener 1424 attaches to the connecting arm 1421 via pin 1422 which provides a pivot joint. A cage 1423 attaches to fastener 1424, and the cage supports a hydraulic cylinder 1425. An upper fastener 1424 pivots around anchor 1901 via pin 1422. Stopper 1510 provides a cushion between upper arm 1405 and support wall 1400. A saddle S can be placed on each saddle rack 800, 810, 820, 830.

Figure 14:
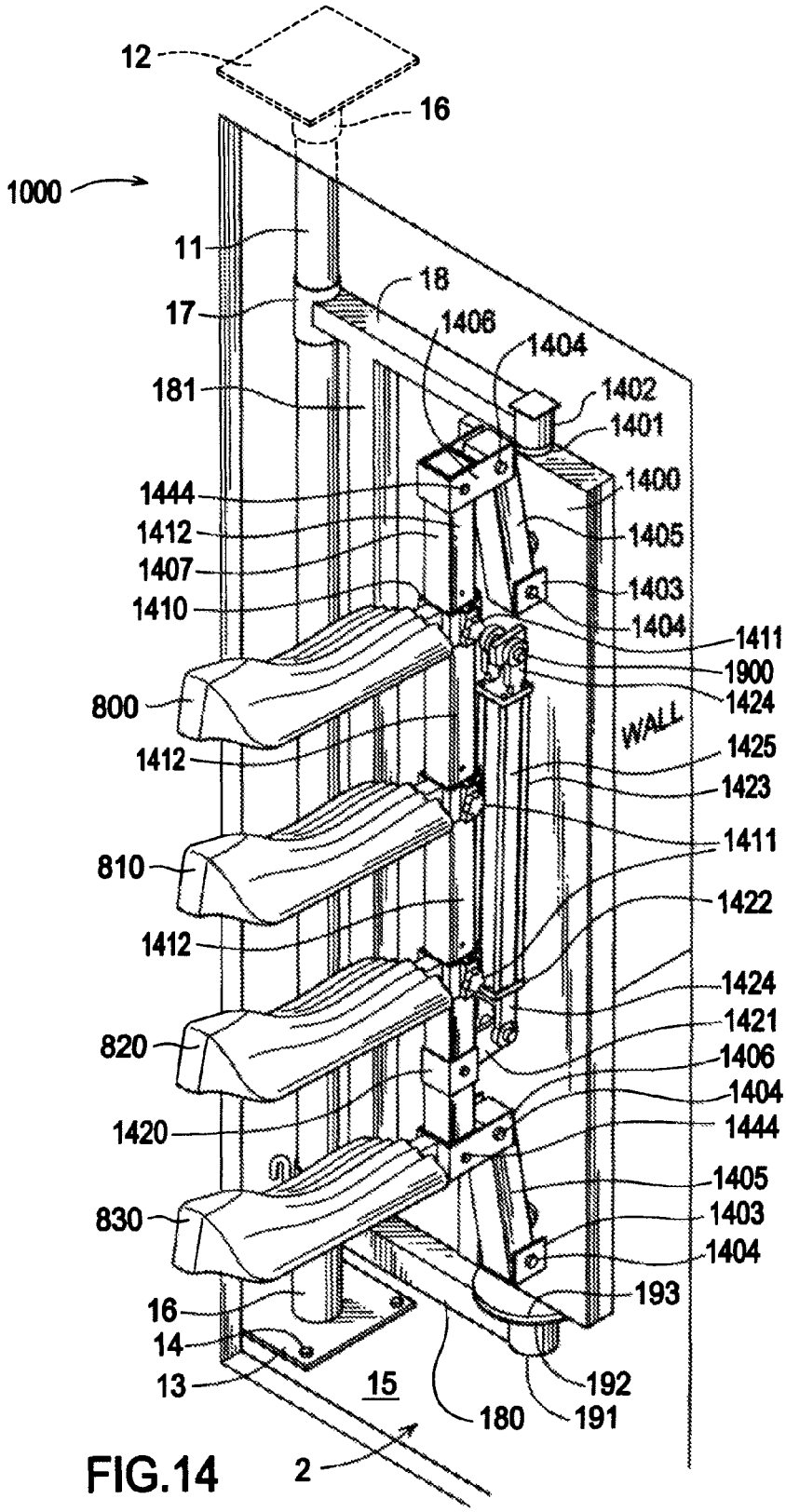
FIG. 14 is a front perspective view of a hydraulic embodiment saddle rack in the up position, rotated outbound.

In FIG. 14 the rod 1407 is powered to the up position, and the working frame 1900 is rotated outbound adjacent to the doorway 2. The support wall 1400 is also rotated outbound to face the doorway 2. The rod 1407 can now be lowered to accept saddles S.

Figure 17:
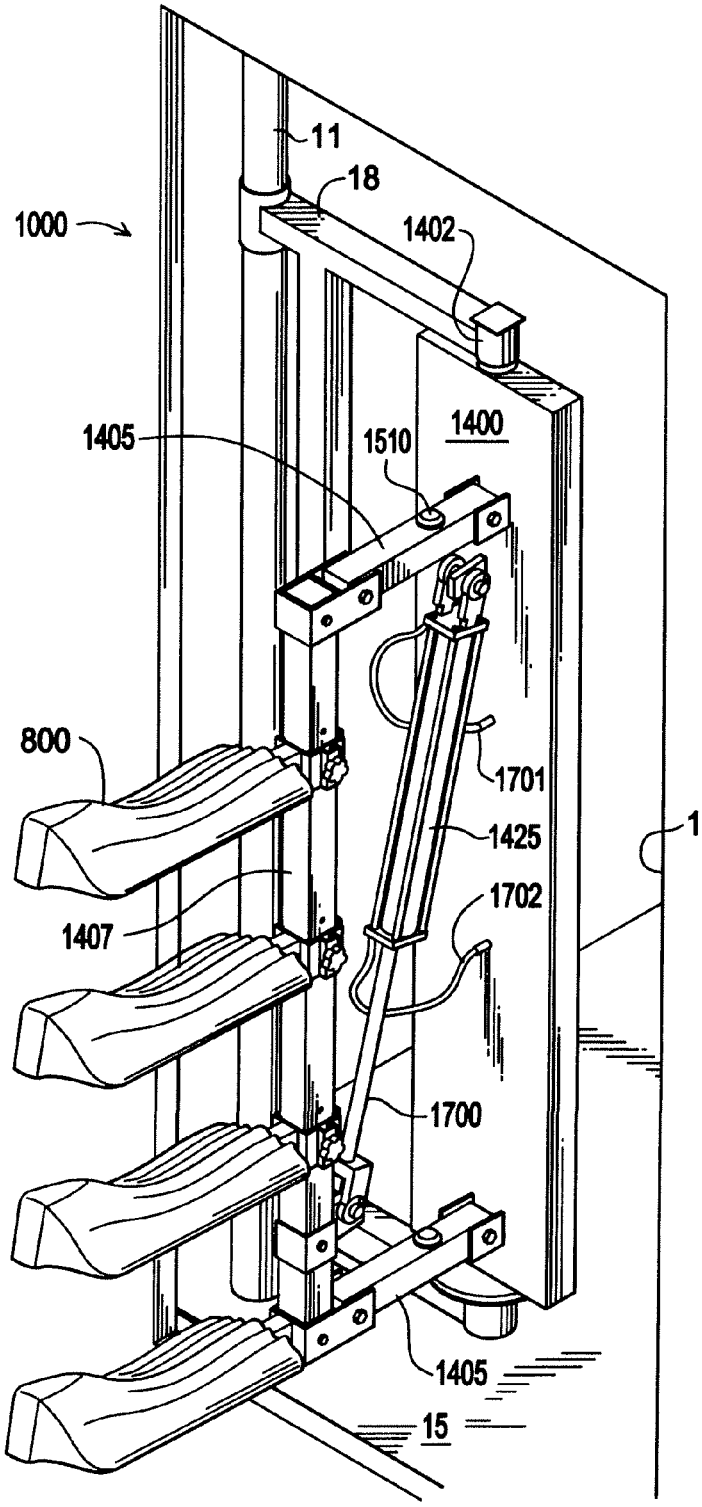
FIG. 17 is the same view as shown in FIG. 14 in the transition position.
Figure 15:
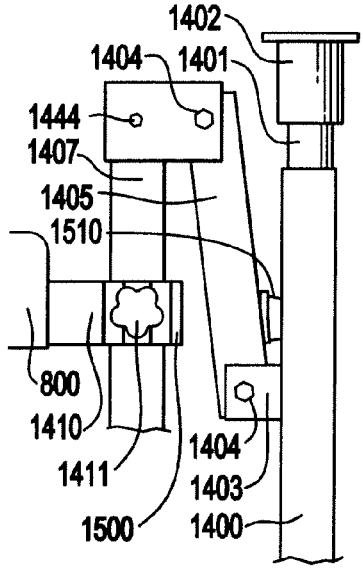
FIG. 15 is a right side plan view of the upper articulating joint of the embodiment shown in FIG. 14.
Figure 16:
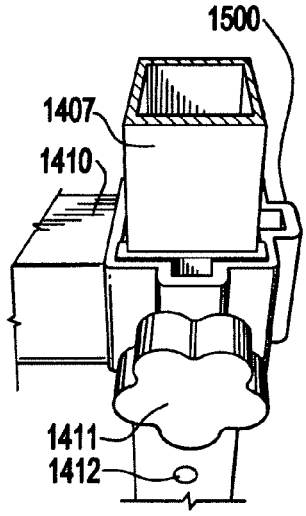
FIG. 16 is a close up perspective view of the rack arm back knob shown in FIG. 15.

In FIG. 17 the hydraulic piston arm 1700 is powered to a transition position where arms 1405 are perpendicular to support wall 1400. Control lines 1701, 1702 conduct hydraulic fluid in a known manner to hydraulic cylinder 1425.

Figure 18:
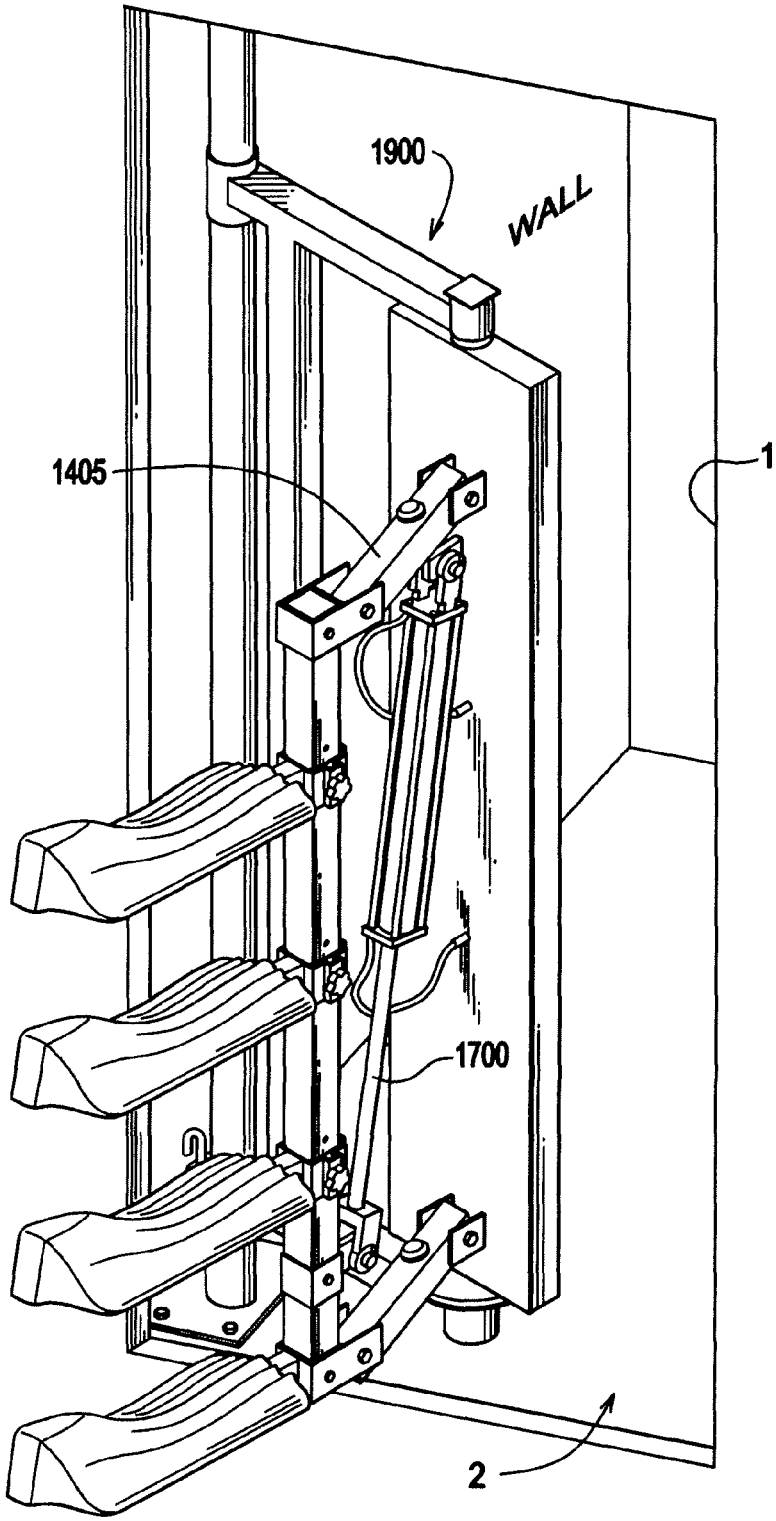
FIG. 18 is the same view as shown in FIG. 14 in the down position where the saddles can be easily loaded and unloaded.

In FIG. 18 the piston arm 15 is at its fully extended position moving arms 1405 downward, and support rod 1407 is at its lowest position. This is the load/unload position.

Figure 20:
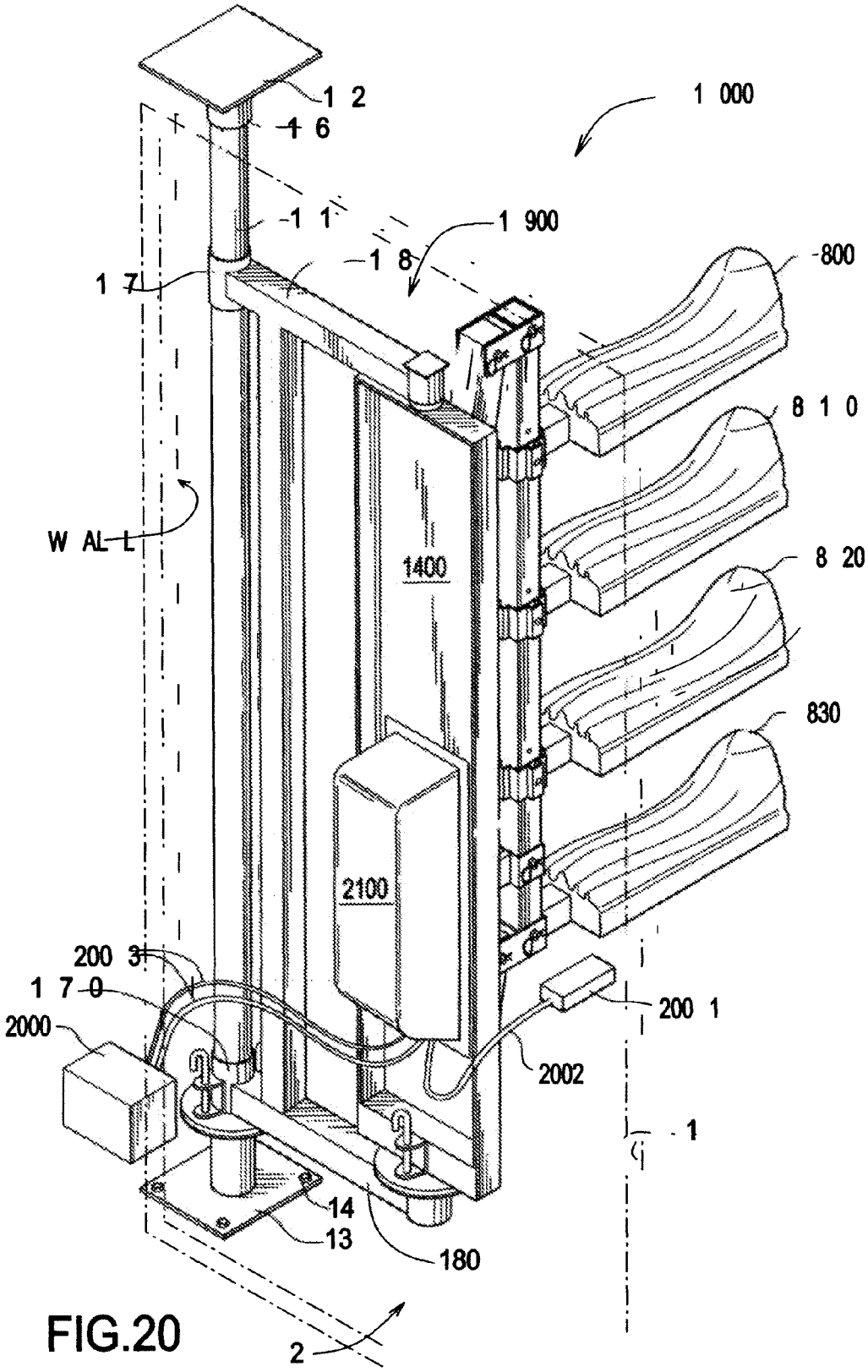
FIG. 20 is the same view as FIG. 14 with the saddle rack in the rotated inbound position for storage.
Figure 21:
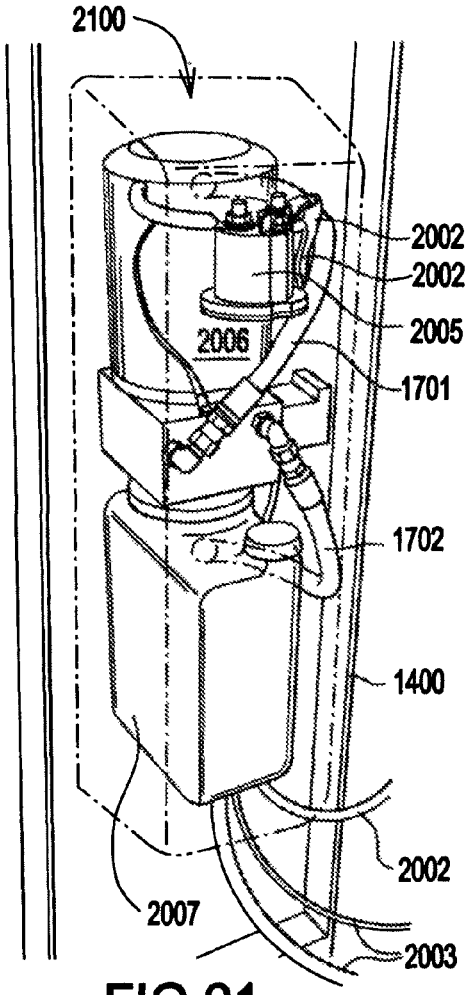
FIG. 21 is a side perspective view of the hydraulic pump.

In FIGS. 20, 21 the battery 2000 and power wires 2003 to the hydraulic system 2100 can be seen. The hand controller 2001 and its wires 2002 to the controller 2005 for the pump 2006 are shown. Hydraulic reservoir 2007 holds the hydraulic fluid sent to control lines 1701, 1702. In FIG. 20 the support wall 1400 has been manually rotated counter-clockwise 180° so as to face away from doorway 2. The pin 520 has been released, and the working frame 1900 is rotated counter-clockwise to put the saddle racks 800-830 in the storage position against the wall of the tack room.

Figure 19:
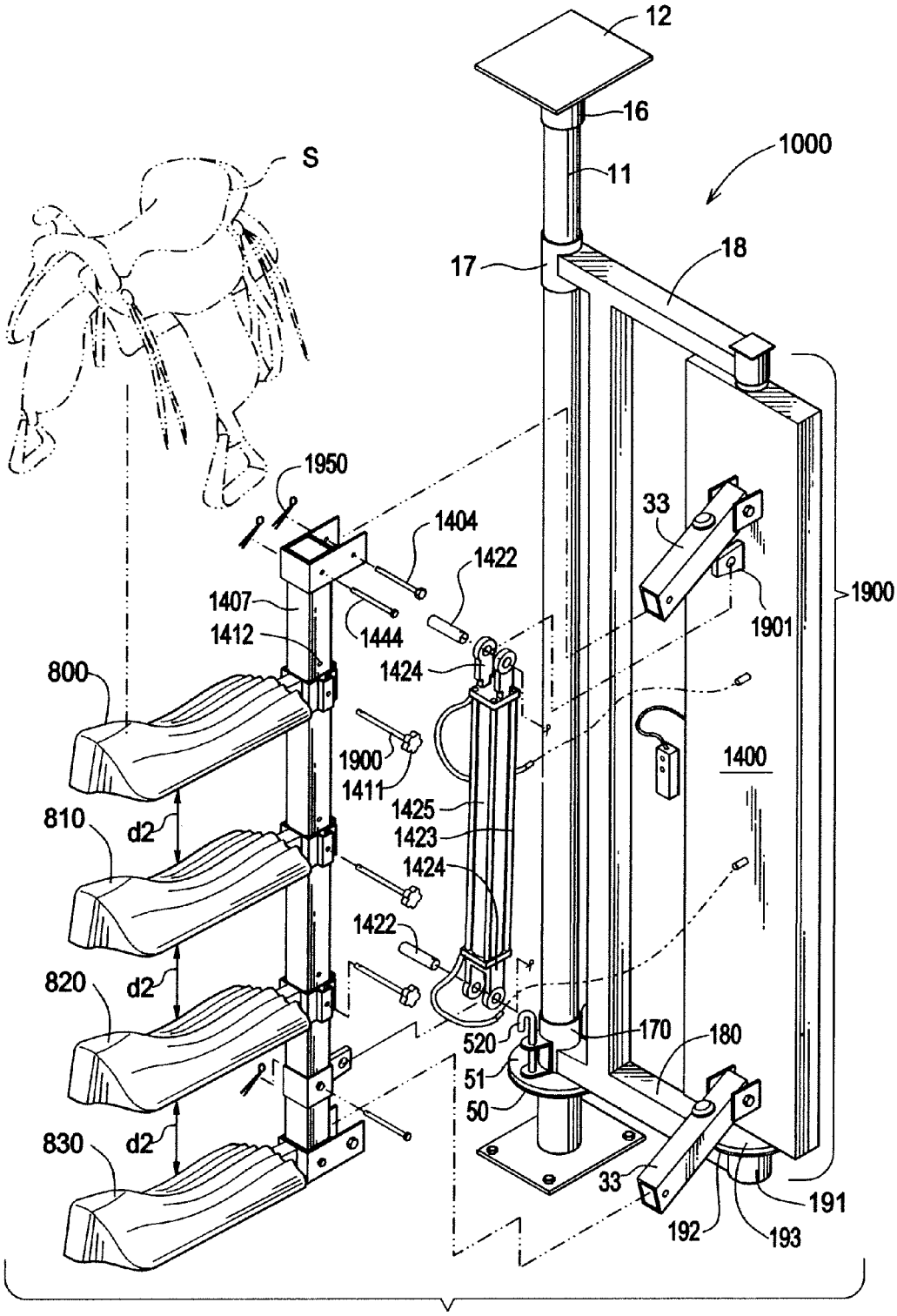
FIG. 19 is an exploded view of the embodiment shown in FIG. 14.
Figure 22:
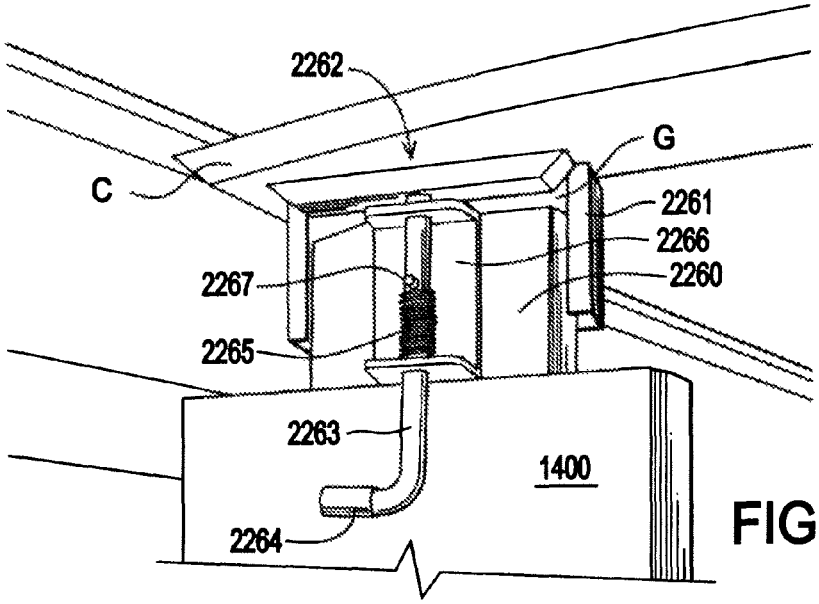
FIG. 22 is a close up view of the ceiling latch shown in FIG. 24.
Figure 23:
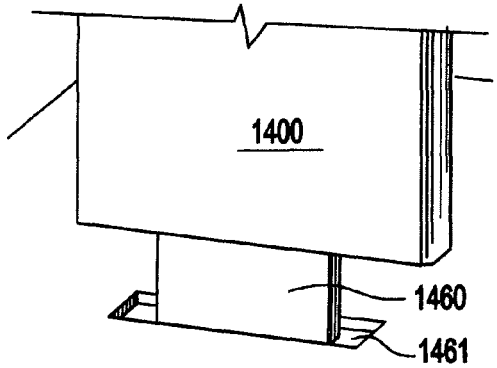
FIG. 23 is a close up view of the floor anchor shown in FIG. 24.
Figure 24:
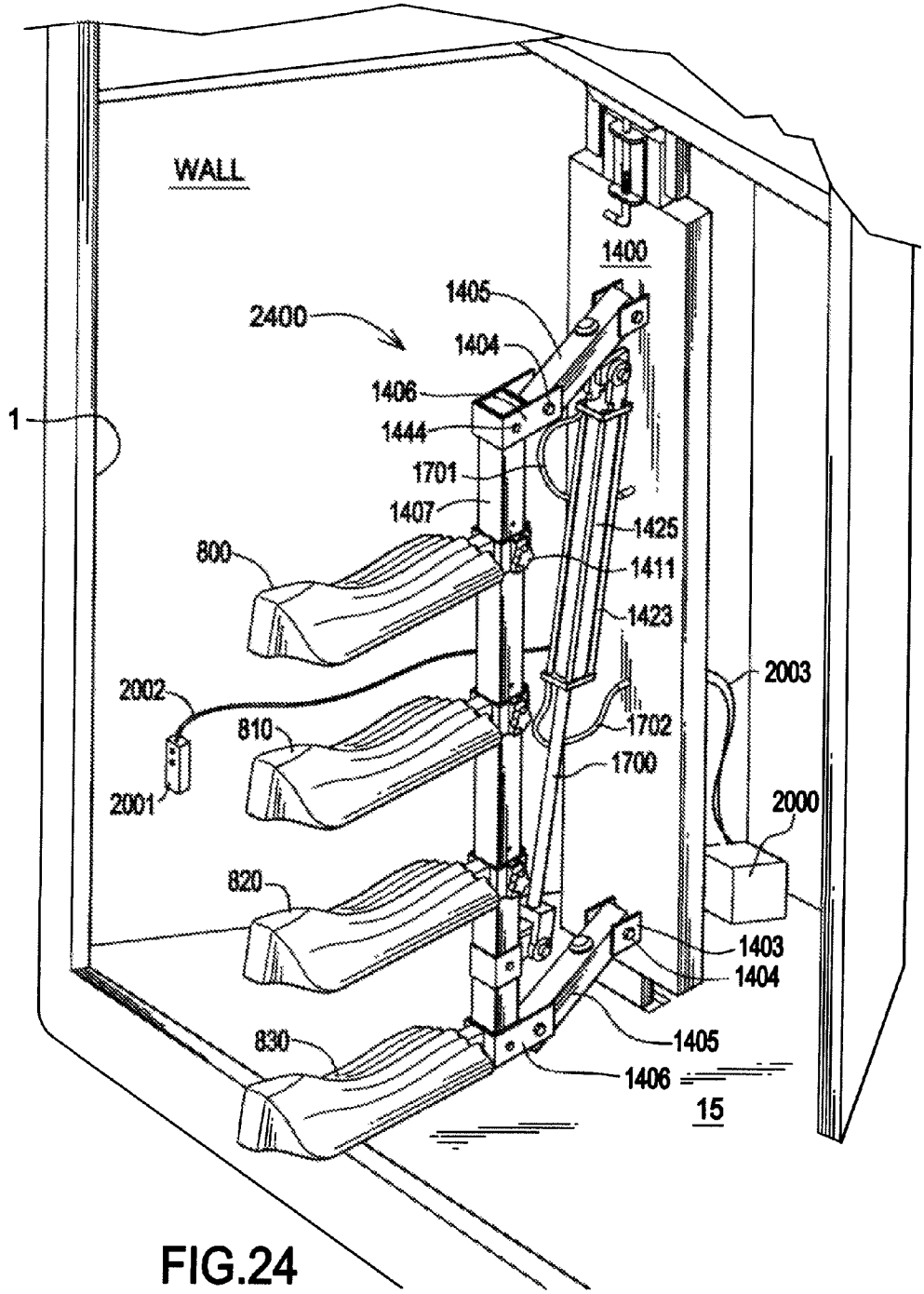
FIG. 24 is a front perspective view of a portable hydraulic embodiment.

Referring last to FIGS. 22, 23, 24 a portable rack lift 2400 has the same support wall 1400 as the system 1000 of FIG. 19 and the same hydraulic components and raising and lowering components of FIG. 19. The support wall 1400 does not rotate. Instead a lower anchor 1460 is received by a slot 1461 in the floor 15.

The support wall 1400 is lifted into frame members 2261 until gap G is minimized, and locking pin 2263 is inserted into hole 2262 in the ceiling C. Then anchor 1460 is lowered into slot 1461. The spring 2265 via stud 2267 pushes the locking pin 2263 into the hole 2262. The bracket 2266 is mounted to the anchor 2260 which is received by frame 2261. Handle 2264 allows the user to release the locking pin 2263 and remove the support wall 1400.

Figure 25:
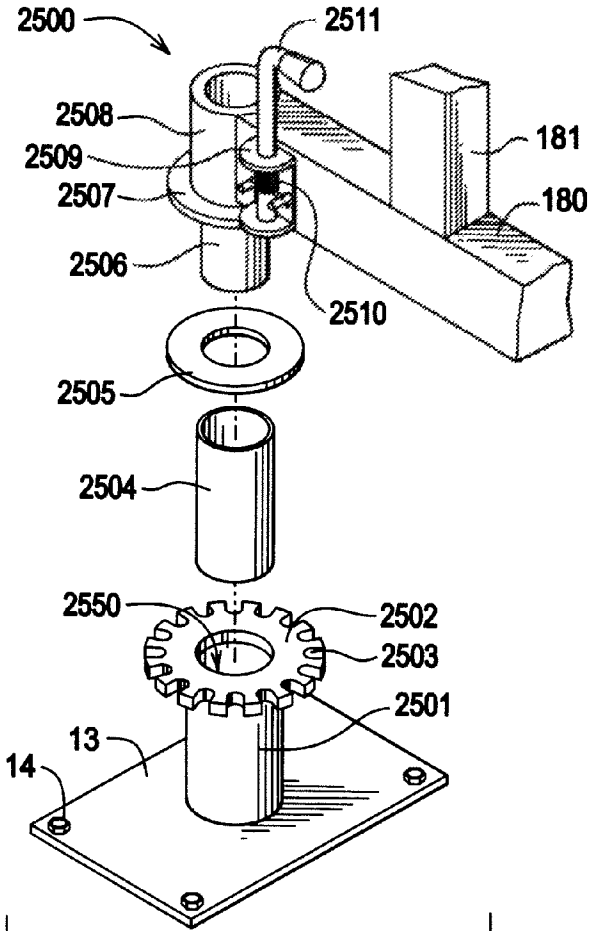
FIG. 25 is a exploded view of an alternate embodiment slotted base for the vertical support beam 181.

Referring next to FIGS. 25-28 a slotted base saddle rack is numbered 2500. In FIG. 25 the anchor plate 13 has a support collar 2501 which supports a slotted flange 2502. Multiple slots 2503 receive locking pin 2511 to lock bracket 180 at a desired angle. The bracket 180 is supported by a collar 2506 which fits into hole 2550. Collar 2506 joins flange 2507 and upper beam 2508. A cylindrical busing 2504 and plastic (preferably Nylon®) bushing 2505 provide a lubrication free pivot for the bracket 180.

The locking pin 2511 is supported by a bracket 2509 having a spring 2510 which forces pin 2511 down into a slot 2503.

Figure 26:
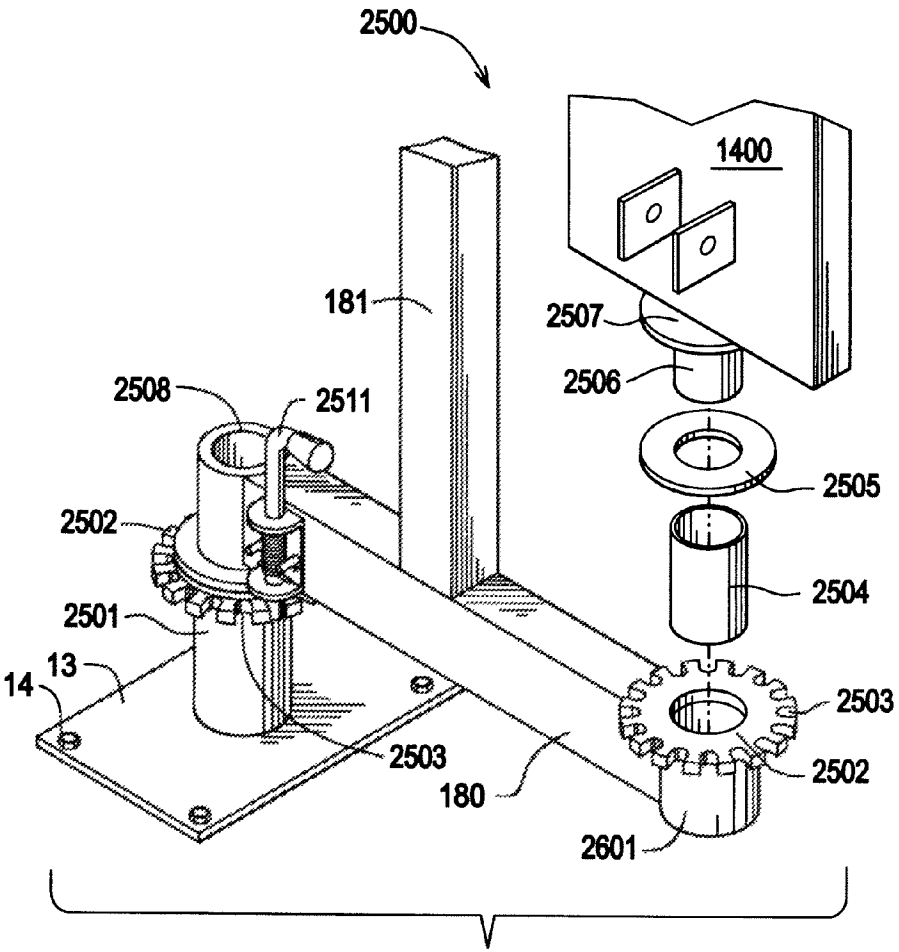
FIG. 26 is an exploded view of an alternate embodiment slotted base for the support wall 1400.

In FIG. 26 a support collar 2601 supports a slotted flange 2502. Cylindrical bushing 2504 and plastic busing 2505 provide a lubrication free pivot for collar 2506 and flange 2507 which support the support wall 1400.

Figure 27:
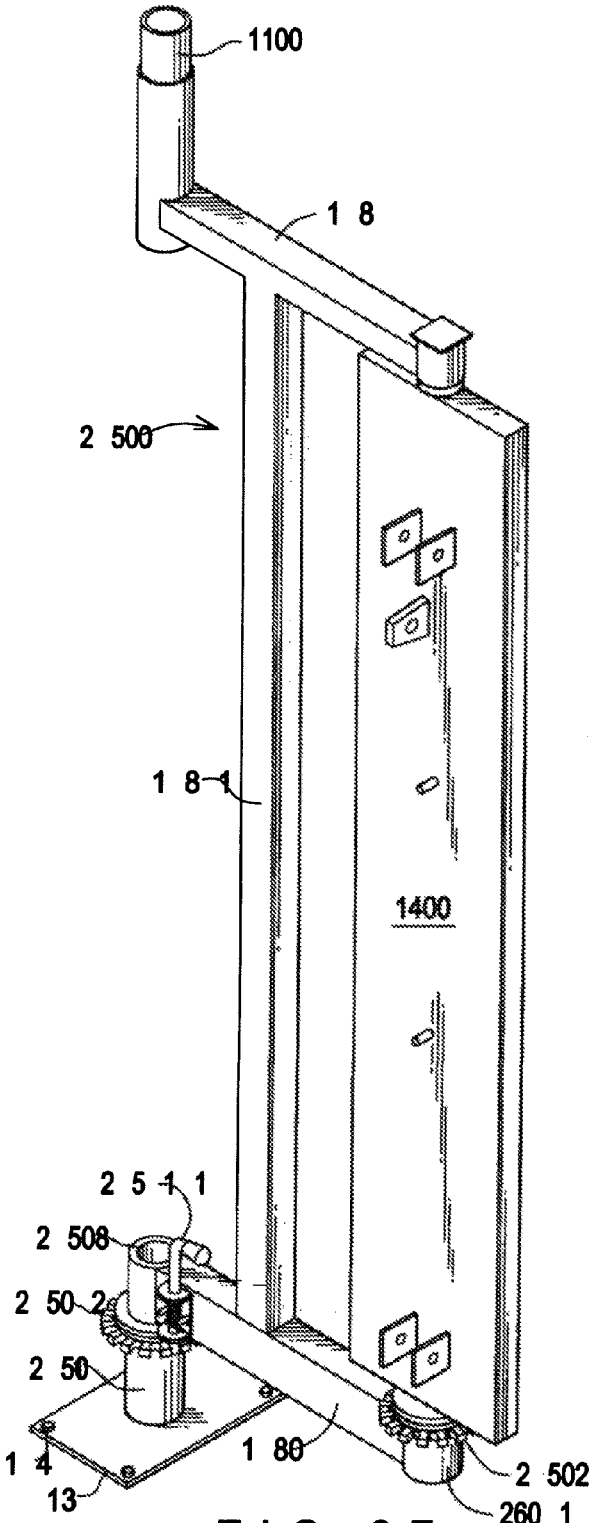
FIG. 27 is a front perspective view of the dual slotted base embodiment.

FIG. 27 shows the embodiment 2500 assembled with all other parts removed which are the same as those shown in the embodiment shown in FIG. 14.

Figure 28:
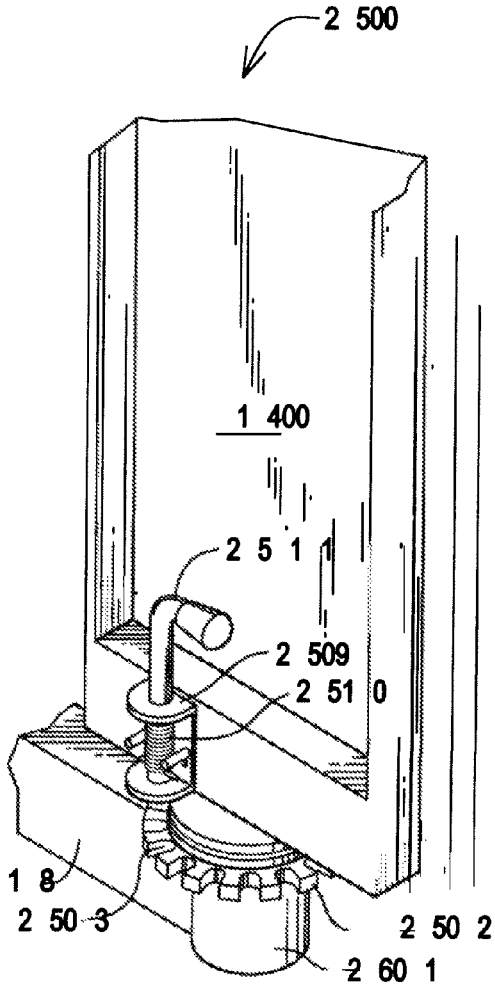
FIG. 28 is a rear perspective view of the slotted base for the support wall 1400.
Figure 29:
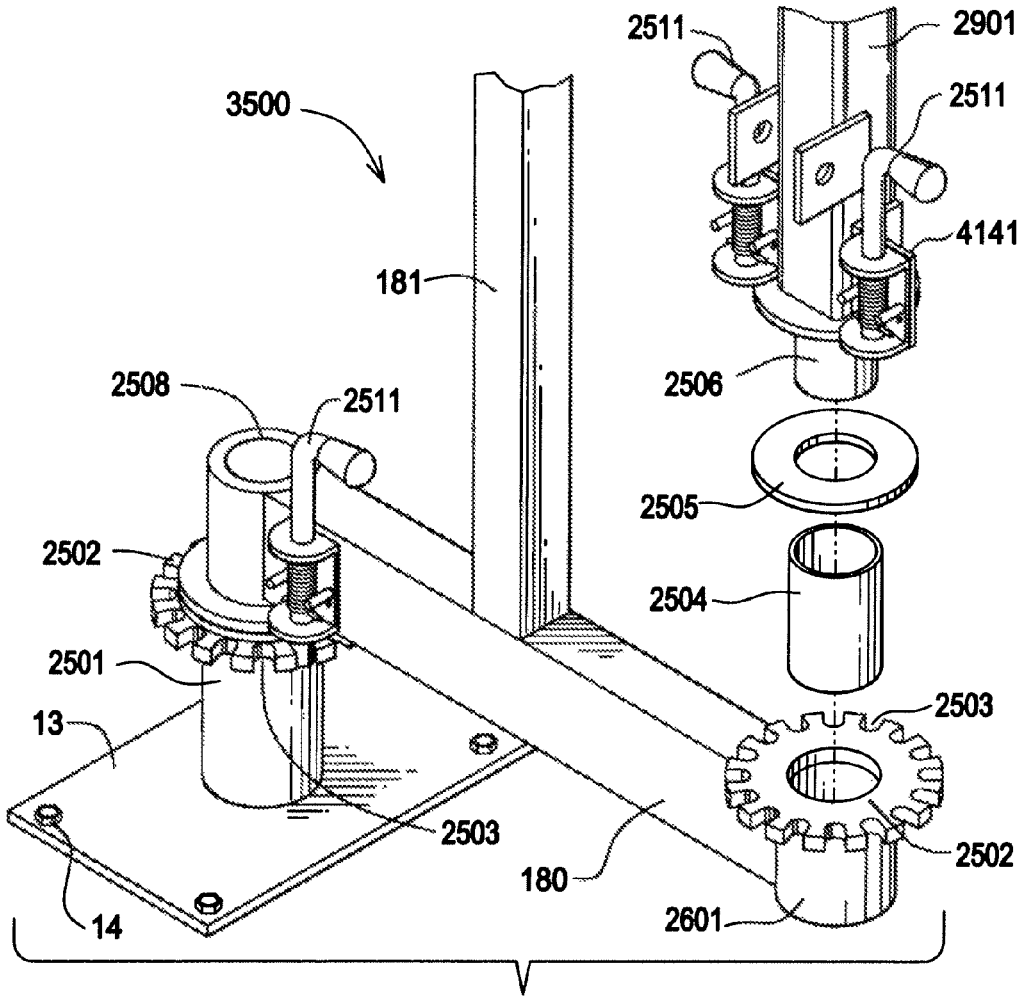
FIG. 29 is a close up perspective view of an alternate embodiment base for the hydraulic lift assembly.
Figure 30:
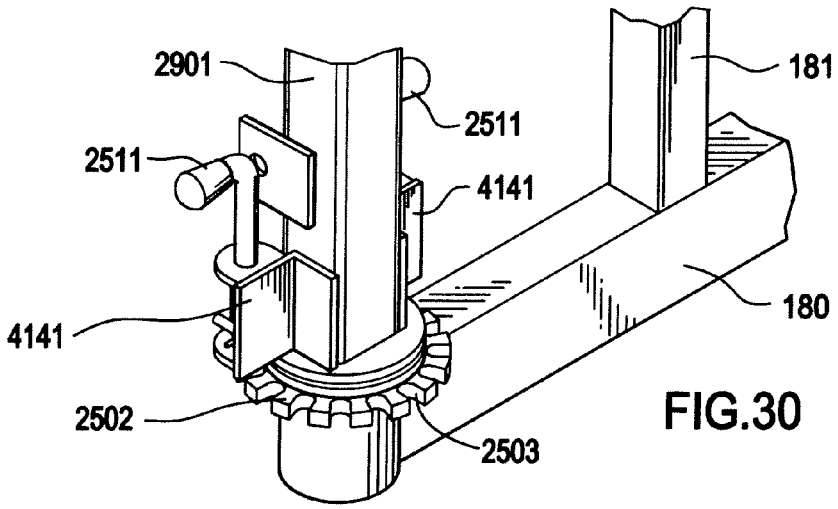
FIG. 30 is a perspective view of the FIG. 29 base.
Figure 31:
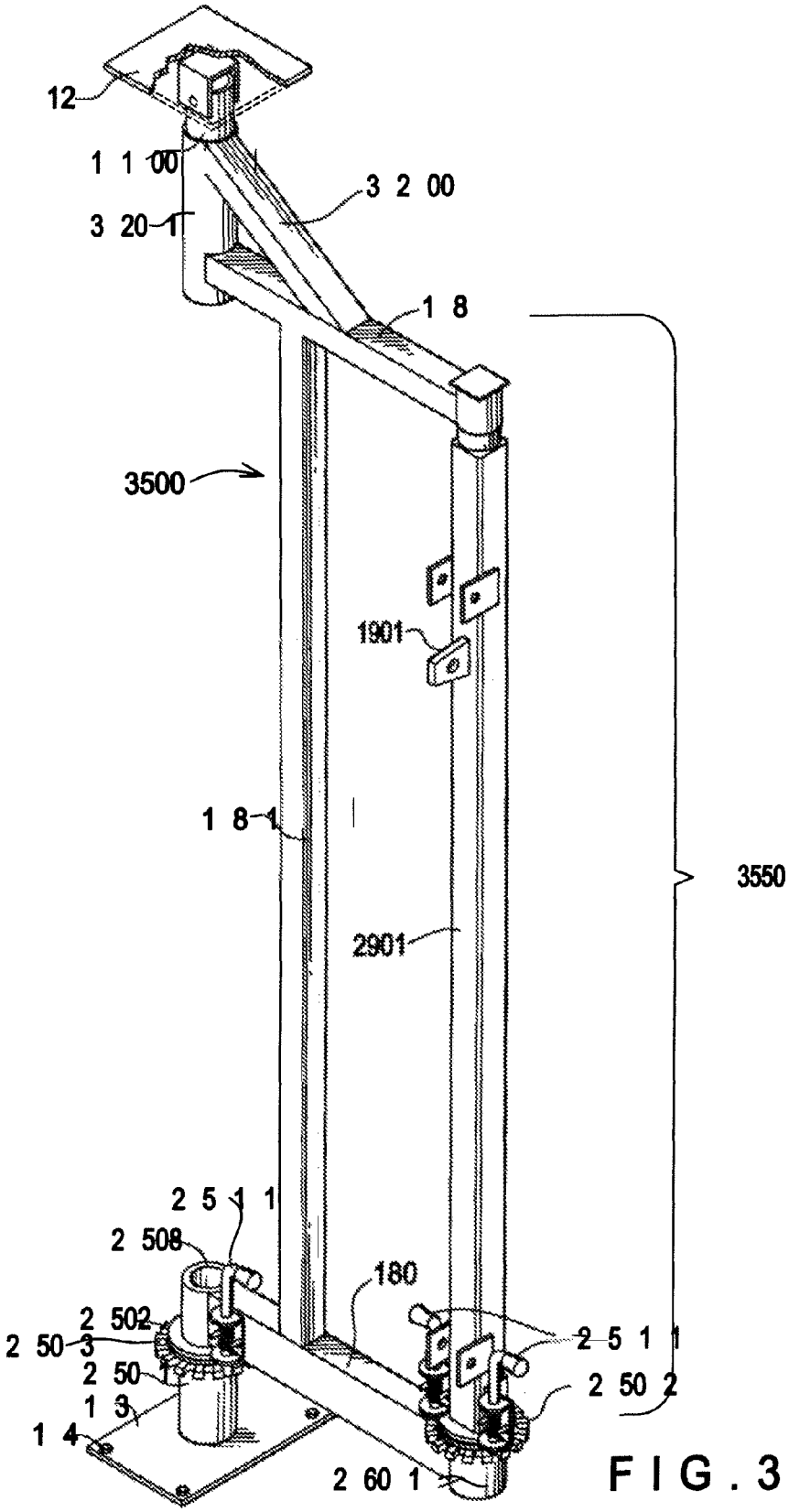
FIG. 31 is a front perspective view of an alternative embodiment frame for the hydraulic lift assembly.
Figure 32:
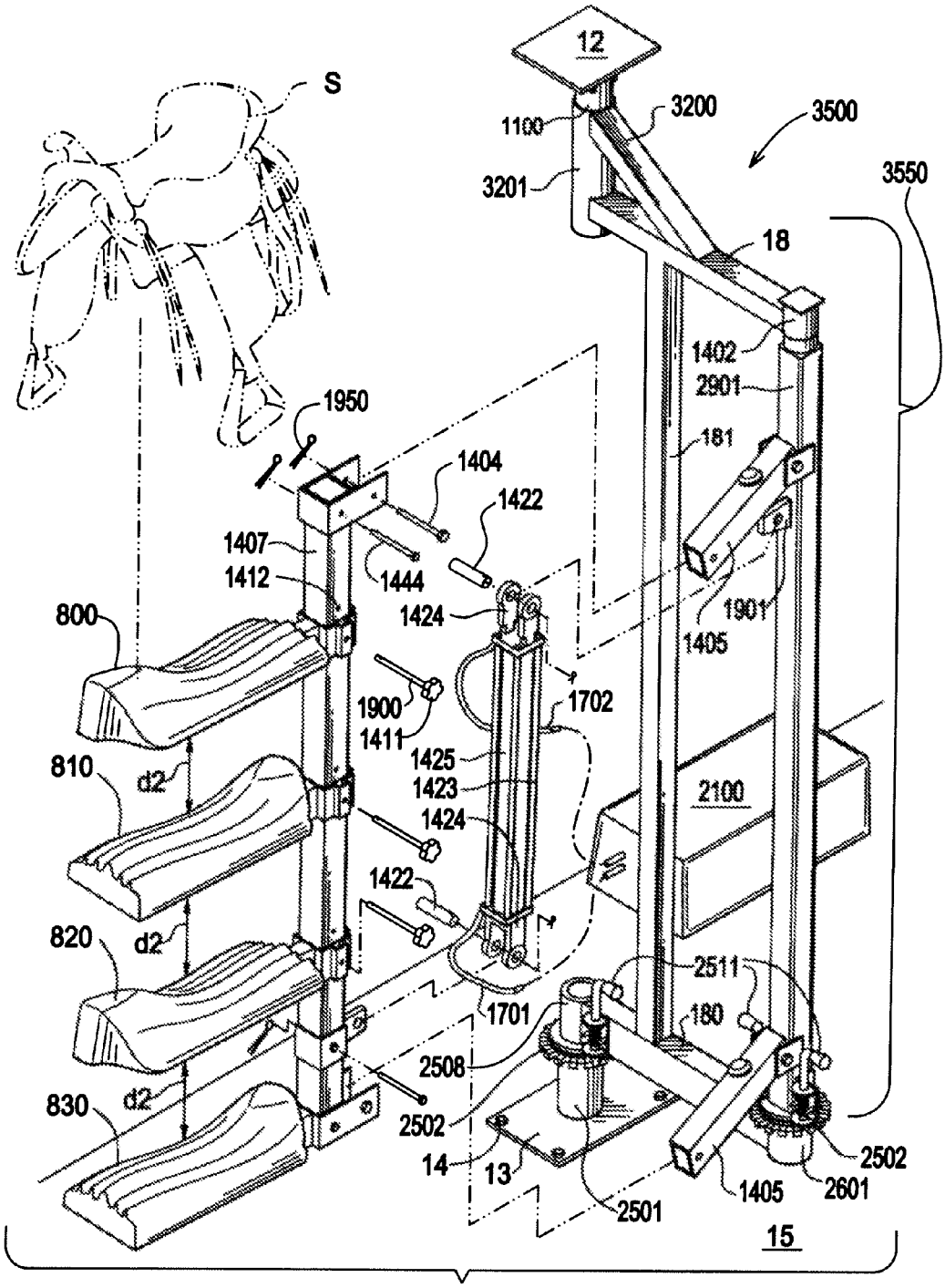
FIG. 32 is an exploded view of the FIG. 31 frame with the hydraulic assembly shown.
Figure 33:
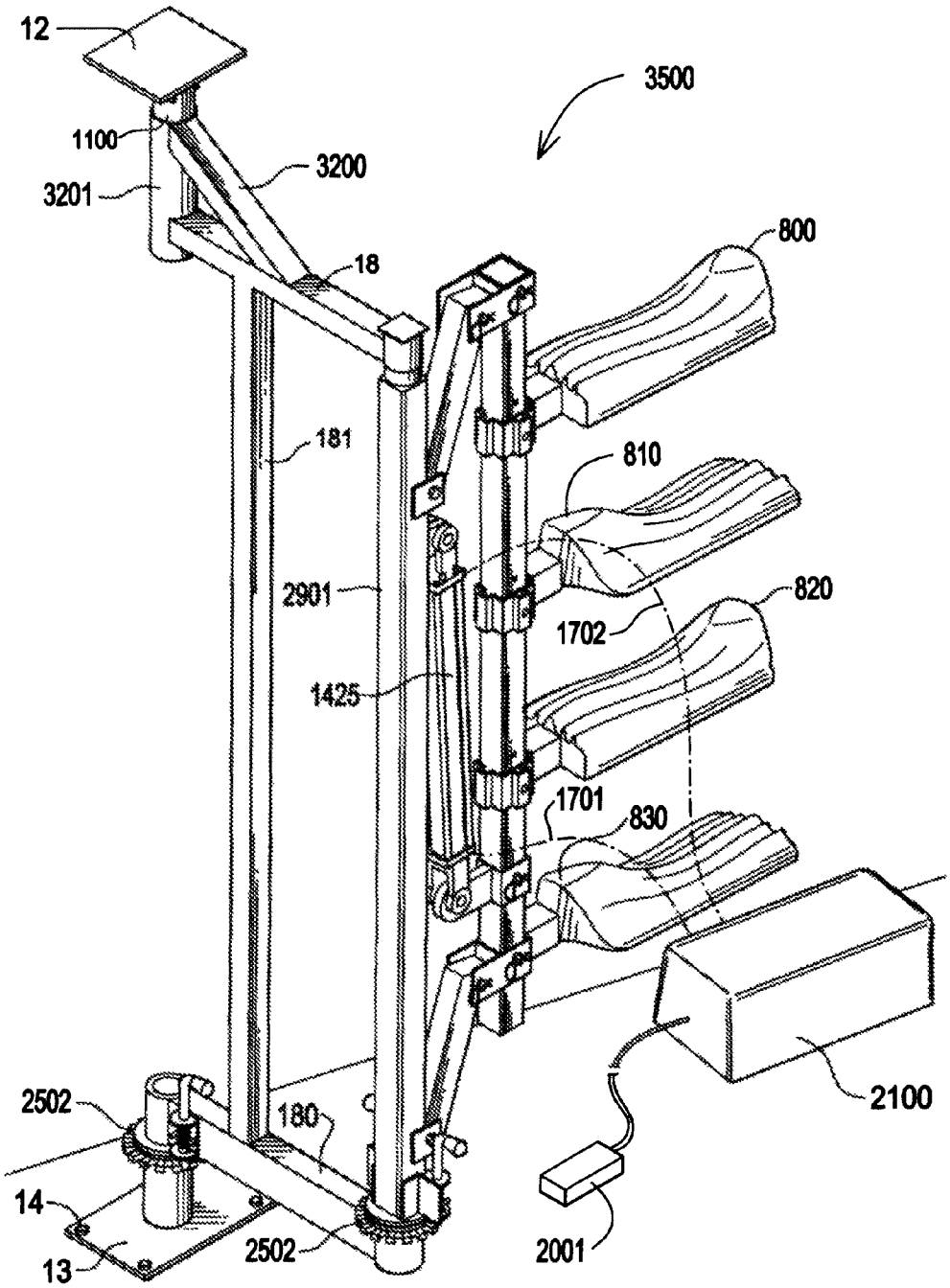
FIG. 33 is a rear perspective view of the FIG. 32 embodiment.

FIG. 28 shows the rear of support wall 1400 and the locking pin 2511 which locks into slots 2503 to secure the support wall 1400 at a desired rotational angle.

Referring next to FIGS. 29, 30, 31, 32, 33 a saddle rack lift 3500 is shown. The pivot assembly 3550 consists of a ceiling anchor 12 which has pivot shaft 1100 connected to it. A collar 3201 pivots around pivot shaft 1100. The collar 3201 supports a bracket 18 which is stabilized by buttress 3200. Collars 1402, 2601 support the pivotable post 2901 which in turn supports the hydraulic cylinder 1425. A floor mounted hydraulic system 2100 supplies hydraulic fluid to the hydraulic cylinder 1425 via lines 1701, 1702.

The floor anchor 13 supports a stationary post 2501 around which collar 2508 pivots. Locking pin 2511 associated with the collar 3203 provides locking the pivot assembly 3550 at a desired angle. Dual locking pins 2511 associated with collar 2601 provide locking the post 2901 at a desired angle. L shaped brackets 4141 support the locking pins 2511.

Figure 34:
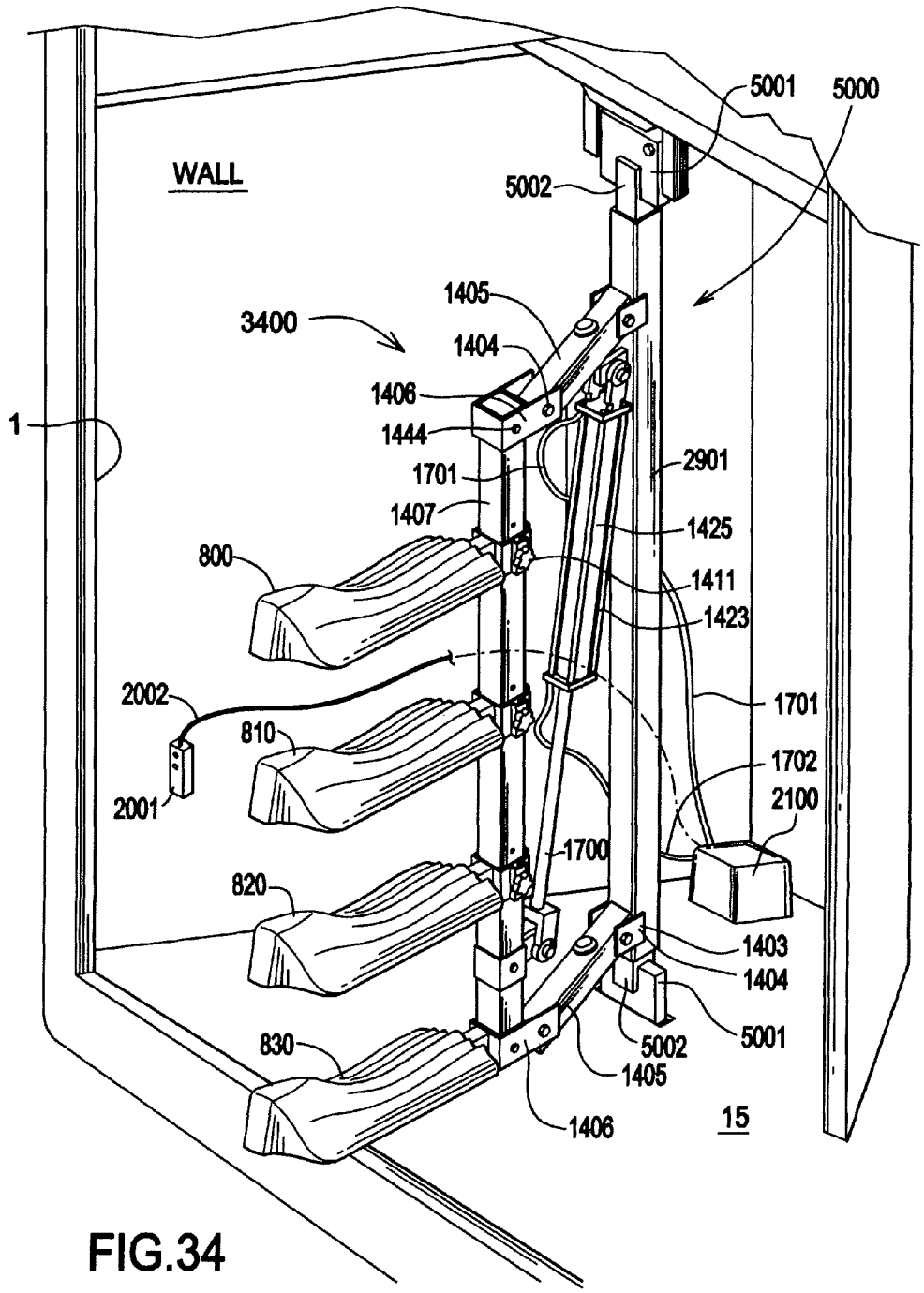
FIG. 34 is a front perspective view of another embodiment of a non-pivoting design similar to the FIG. 24 embodiment.

Referring next to FIG. 34 a portable saddle rack lift 5000 floor and ceiling receiving blocks 5001, upon which guides 5002 can be mounted and removed. Post 2901 cannot pivot.

Although the present invention has been described with reference to preferred embodiments, numerous modifications and variations can be made and still the result will come within the scope of the invention. No limitation with respect to the specific embodiments disclosed herein is intended or should be inferred. Each apparatus embodiment described herein has numerous equivalents.

I claim:

1. A saddle rack lift comprising:

a base mounting rod around which a saddle rack lift frame pivots;

said saddle rack lift frame comprising a vertical rack raising rod with at least one saddle rack and having an upper and a lower lift arm each pivotally mounted to the saddle rack lift frame;

a lift means anchored to the saddle rack lift frame functioning to raise and lower the vertical rack raising rod;

wherein the saddle rack lift frame further comprises a pivot assembly for the vertical rack raising rod; and wherein the base mounting rod further comprises a fixed flange upon which a pivotable flange pivots, wherein a locking pin locks the two flanges together at a desired angle.

2. The apparatus of claim 1, wherein the lift means further comprises a powered pulley system having a cable attached to the vertical rack raising rod and a powered reel which raises and lowers the vertical rack raising rod by means of the cable.

3. The apparatus of claim 1, wherein the at least one saddle rack has an adjustable vertical position along the vertical rack raising rod.

4. The apparatus of claim 2, wherein the powered pulley system further comprises a battery powered electric motor.

5. The apparatus of claim 1, wherein the saddle rack lift frame pivot assembly further comprises a base bracket with said pivotable flange which rides on said fixed flange on a lower horizontal bracket, wherein said locking pin locks the two flanges together at a desired angle.

6. The apparatus of claim 1, wherein the at least one saddle rack can be rotated about 180° by means of pivoting the saddle rack lift frame around the base mounting rod and the vertical rack raising rod within the saddle rack lift frame.

7. The apparatus of claim 1, wherein the lift means further comprises a hydraulic cylinder connected to the vertical rack raising rod.

8. A saddle rack lift comprising:

a base mounting rod around which a saddle rack lift frame pivots;

said saddle rack lift frame comprising a vertical rack raising rod with at least one saddle rack and having an upper and a lower lift arm each pivotally mounted to the saddle rack lift frame;

an actuator means anchored to the saddle rack lift frame functioning to raise and lower the vertical rack raising rod;

wherein the saddle rack lift frame further comprises a pivot assembly for the vertical rack raising rod;

wherein a floor anchor further comprises a fixed flange with teeth and gaps over which a spring loaded locking pin on the saddle rack lift frame pivots, wherein the locking pin locks into a chosen gap at a desired angle;

wherein the saddle rack lift frame pivot assembly further comprises a base bracket with a spring loaded locking pin which rides over a fixed flange having teeth and gaps on a lower horizontal bracket;

wherein the locking pin locks a vertical support member for the vertical rack raising rod at a desired angle;

wherein the at least one saddle rack can be rotated about 180° by means of pivoting the saddle rack lift frame around the base mounting rod and the vertical rack raising rod within the saddle rack lift frame; and wherein the base mounting rod is anchored in a tack room of a horse trailer adjacent a door, and wherein a pivoting of the saddle rack lift frame outbound from the door, and a pivoting of the pivot assembly for the vertical rack raising rod outbound from the door results in the at least on saddle rack extending outside the door of the tack room, thereby providing ease of access for mounting/dismounting a saddle from the saddle rack.

9. A saddle rack lift comprising:

a base mounting rod around which a saddle rack lift frame pivots;

said saddle rack lift frame comprising a vertical rack raising rod with at least one saddle rack and having an upper and a lower lift arm each pivotally mounted to the saddle rack lift frame;

a lift means anchored to the saddle rack lift frame functioning to raise and lower the vertical rack raising rod;

wherein the saddle rack lift frame further comprises a pivot assembly for the vertical rack raising rod; and wherein the saddle rack lift frame pivot assembly further comprises a base bracket with a pivotable flange which rides on a fixed flange on a lower horizontal bracket;

wherein a locking pin locks the two flanges together at a desired angle.

10. A saddle rack lift comprising:

a base mounting rod around which a saddle rack lift frame pivots;

said saddle rack lift frame comprising a vertical rack raising rod with at least one saddle rack and having an upper and a lower lift arm each pivotally mounted to the saddle rack lift frame;

a lift means anchored to the saddle rack lift frame functioning to raise and lower the vertical rack raising rod; and wherein the base mounting rod is anchored in a tack room of a horse trailer adjacent a door, and wherein a pivoting of the saddle rack lift frame outbound from the door and a pivoting of the pivot assembly for the vertical rack raising rod outbound from the door results in the at least one saddle rack extending outside the door of the tack room, thereby providing ease of access for mounting/dismounting a saddle from the saddle rack.

* * * * *